US009588451B2

(12) United States Patent
Takeyama et al.

(10) Patent No.: US 9,588,451 B2
(45) Date of Patent: Mar. 7, 2017

(54) TONER, DEVELOPER, AND IMAGE FORMING APPARATUS

(71) Applicants: Akihiro Takeyama, Kanagawa (JP); Shinya Nakayama, Shizuoka (JP); Akinori Saitoh, Shizuoka (JP); Shinsuke Nagai, Shizuoka (JP); Hiroyuki Takeda, Kanagawa (JP)

(72) Inventors: Akihiro Takeyama, Kanagawa (JP); Shinya Nakayama, Shizuoka (JP); Akinori Saitoh, Shizuoka (JP); Shinsuke Nagai, Shizuoka (JP); Hiroyuki Takeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 11 days.

(21) Appl. No.: 14/696,881

(22) Filed: Apr. 27, 2015

(65) Prior Publication Data

US 2015/0323878 A1 Nov. 12, 2015

(30) Foreign Application Priority Data

May 12, 2014 (JP) ..... 2014-098558

(51) Int. Cl.
*G03G 9/087* (2006.01)
*G03G 9/08* (2006.01)
*G03G 9/097* (2006.01)

(52) U.S. Cl.
CPC ..... *G03G 9/08755* (2013.01); *G03G 9/0815* (2013.01); *G03G 9/08793* (2013.01); *G03G 9/08797* (2013.01); *G03G 9/09716* (2013.01)

(58) Field of Classification Search
CPC ..... G03G 9/08755; G03G 9/08797
USPC ..... 430/109.4
See application file for complete search history.

(56) References Cited

U.S. PATENT DOCUMENTS

| | | | | |
|---|---|---|---|---|
| 7,172,844 | B2 | 2/2007 | Umemura et al. | |
| 7,261,989 | B2 | 8/2007 | Sugiura et al. | |
| 7,318,989 | B2 | 1/2008 | Kotsugai et al. | |
| 7,374,851 | B2 | 5/2008 | Nakayama et al. | |
| 7,449,273 | B2 | 11/2008 | Ohki et al. | |
| 7,455,942 | B2 | 11/2008 | Nagatomo et al. | |
| 7,459,255 | B2 | 12/2008 | Tanaka et al. | |
| 7,504,188 | B2 | 3/2009 | Yamada et al. | |
| 7,531,279 | B2 | 5/2009 | Watanabe et al. | |
| 7,759,036 | B2 | 7/2010 | Utsumi et al. | |
| 7,892,714 | B2 * | 2/2011 | McDougall | G03G 9/08728 430/108.3 |
| 8,043,780 | B2 | 10/2011 | Sugiura et al. | |
| 8,084,176 | B2 | 12/2011 | Iwamoto et al. | |
| 8,211,605 | B2 * | 7/2012 | Yamada | G03G 9/0804 430/108.1 |
| 2004/0067189 | A1 | 4/2004 | Sugiura et al. | |
| 2004/0072091 | A1 | 4/2004 | Mochizuki et al. | |
| 2004/0076443 | A1 | 4/2004 | Suzuki et al. | |
| 2004/0115550 | A1 | 6/2004 | Sugiura et al. | |
| 2005/0026064 | A1 | 2/2005 | Sugiura et al. | |
| 2005/0031980 | A1 | 2/2005 | Inoue et al. | |
| 2005/0089786 | A1 | 4/2005 | Sugiura et al. | |
| 2005/0089787 | A1 | 4/2005 | Uchinokura et al. | |
| 2005/0164112 | A1 | 7/2005 | Ohki et al. | |
| 2005/0208408 | A1 | 9/2005 | Uchinokura et al. | |
| 2006/0029433 | A1 | 2/2006 | Saito et al. | |
| 2006/0057488 | A1 | 3/2006 | Inoue et al. | |
| 2006/0068312 | A1 | 3/2006 | Yamashita et al. | |
| 2006/0099529 | A1 | 5/2006 | Tanaka et al. | |
| 2006/0160011 | A1 | 7/2006 | Inoue et al. | |
| 2006/0210903 | A1 | 9/2006 | Ohki et al. | |
| 2007/0059063 | A1 | 3/2007 | Nakayama et al. | |
| 2007/0059626 | A1 | 3/2007 | Inoue et al. | |
| 2007/0141506 | A1 | 6/2007 | Inoue et al. | |
| 2007/0190444 | A1 | 8/2007 | Kotsugai et al. | |
| 2007/0218391 | A1 | 9/2007 | Yamada et al. | |
| 2007/0218392 | A1 | 9/2007 | Yamada et al. | |
| 2008/0013987 | A1 * | 1/2008 | Shoji | G03G 9/0819 399/252 |
| 2008/0014527 | A1 | 1/2008 | Kotsugai et al. | |
| 2008/0076055 | A1 | 3/2008 | Sawada et al. | |
| 2008/0118855 | A1 | 5/2008 | Nakayama et al. | |
| 2008/0213682 | A1 | 9/2008 | Saitoh et al. | |
| 2008/0227002 | A1 | 9/2008 | Moriya et al. | |
| 2008/0227018 | A1 | 9/2008 | Awamura et al. | |
| 2008/0233498 | A1 | 9/2008 | Yamada et al. | |

(Continued)

FOREIGN PATENT DOCUMENTS

| | | |
|---|---|---|
| EP | 2 520 979 A1 | 11/2012 |
| JP | 2579150 | 11/1996 |
| JP | 11-133665 | 5/1999 |
| JP | 2001-158819 | 6/2001 |
| JP | 2002-287400 | 10/2002 |
| JP | 2002-351143 | 12/2002 |
| JP | 2004-046095 | 2/2004 |
| JP | 2007-271789 | 10/2007 |
| JP | 2012-118362 | 6/2012 |
| JP | 2013-054178 | 3/2013 |

OTHER PUBLICATIONS

Extended European Search Report issued Sep. 16, 2015 in Patent Application No. 15166791.2.

*Primary Examiner* — Christopher Rodee

(74) *Attorney, Agent, or Firm* — Oblon, McClelland, Maier & Neustadt, L.L.P.

(57) ABSTRACT

A toner, wherein an amount of Al detected in the toner is 0.7% to 1.3%, where the amount of Al detected is determined based on quantitative analysis of Al by X-ray photoelectron spectroscopic analysis (XPS), and wherein [Tg2nd (THF insoluble matter)] is −40° C. to 30° C., where the [Tg2nd (THF insoluble matter)] is a glass transition temperature measured in second heating of differential scanning calorimetry (DSC) of THF insoluble matter of the toner.

20 Claims, 4 Drawing Sheets

(56) References Cited

U.S. PATENT DOCUMENTS

2008/0233511 A1* 9/2008 Ishikawa ..... G03G 9/08755 430/112
2008/0261131 A1 10/2008 Nakayama et al.
2008/0268366 A1 10/2008 Nakayama et al.
2008/0280218 A1 11/2008 Sabu et al.
2008/0280219 A1 11/2008 Nakayama et al.
2008/0311500 A1 12/2008 Yamada et al.
2008/0318143 A1 12/2008 Nakayama et al.
2009/0003885 A1 1/2009 Sabu et al.
2009/0117480 A1 5/2009 Yamada et al.
2009/0142682 A1 6/2009 Saitoh et al.
2009/0280421 A1 11/2009 Awamura et al.
2010/0129748 A1 5/2010 Inoue et al.
2011/0223530 A1 9/2011 Inoue et al.
2011/0236812 A1* 9/2011 Ishihara ..... G03G 9/0819 430/105
2011/0281213 A1 11/2011 Sakashita et al.
2012/0282000 A1 11/2012 Nakayama et al.
2012/0295193 A1 11/2012 Hanatani et al.
2013/0045442 A1 2/2013 Moriya et al.
2013/0059247 A1 3/2013 Sugimoto et al.
2013/0078563 A1 3/2013 Nakayama et al.
2013/0095422 A1 4/2013 Yamamoto et al.
2013/0108950 A1 5/2013 Yamamoto et al.
2013/0115550 A1 5/2013 Amemori et al.
2013/0143155 A1 6/2013 Santo et al.
2013/0157183 A1 6/2013 Santo et al.
2013/0157185 A1 6/2013 Sakashita et al.
2013/0236826 A1 9/2013 Makabe et al.
2013/0244011 A1 9/2013 Sabu et al.
2013/0244153 A1 9/2013 Nakayama et al.
2013/0244154 A1 9/2013 Yamamoto et al.
2013/0244168 A1 9/2013 Yamashita et al.
2013/0252158 A1 9/2013 Yamada et al.
2013/0260298 A1 10/2013 Amemori et al.
2014/0051019 A1 2/2014 Sekiguchi et al.
2014/0065534 A1 3/2014 Amemori et al.
2014/0242514 A1 8/2014 Inoue et al.
2014/0270874 A1 9/2014 Hase et al.
2014/0272695 A1 9/2014 Moritani et al.
2014/0301757 A1 10/2014 Sakashita et al.
2015/0227066 A1 8/2015 Sugiura et al.
2015/0248070 A1 9/2015 Chiba et al.
2015/0253687 A1 9/2015 Chiba et al.
2015/0261113 A1 9/2015 Takeyama et al.

* cited by examiner

TONER, DEVELOPER, AND IMAGE FORMING APPARATUS

BACKGROUND OF THE INVENTION

Field of the Invention

The present invention relates to a toner, a developer, and an image forming apparatus.

Description of the Related Art

In recent years, toners have been required to have smaller particle diameters and hot offset resistance for increasing quality of output images, to have low temperature fixing ability for energy saving, and to have heat resistant storage stability for the toners to be resistant to high-temperature, high-humidity conditions during storage and transportation after production. In particular, improvement in low temperature fixing ability is very important because power consumption in fixing occupies much of power consumption in an image forming step.

Conventionally, toners produced by the kneading pulverizing method have been used. In the toners produced by the kneading pulverizing method, difficulty is encountered in making them have smaller particle diameters, and their shapes are indefinite and their particle size distribution is broad, for which these toners have the following problems, for example: the quality of output images is not sufficient; and the fixing energy required is high. Also, when wax (release agent) has been added for improving fixing ability, the toners produced by the kneading pulverizing method are cracked upon pulverization at the interfaces with the wax, so that much of the wax is disadvantageously present on the toner surface. As a result, although releasing effects can be obtained, deposition (filming) of the toners on carriers, photoconductors, and blades will easily occur. Thus, their entire performances have not been satisfactory, which is problematic.

Then, in order to overcome the above problems accompanied by the kneading pulverizing method, toner production methods based on the polymerization method have been proposed. Toners produced by the polymerization method are easily allowed to have smaller particle diameters, and their particle size distribution is sharper than that of the toners produced by the pulverization method and moreover it is possible to enclose the release agent. In one disclosed toner production method based on the polymerization method, toners are produced from elongated reaction products of urethane-modified polyesters serving as a toner binder for the purpose of improving the low temperature fixing ability and hot offset resistance (see, for example, Japanese Patent Application Laid-Open (JP-A) No. 11-133665).

In addition, there are disclosed production methods for toners excellent in powder flowability and transferability when they are formed to have smaller particle diameters, as well as in all of heat resistant storage stability, low temperature fixing ability, and hot offset resistance (see, for example, JP-A Nos. 2002-287400 and 2002-351143).

Further, there are disclosed production methods for toners including an aging step for producing a toner binder having a stable molecular weight distribution to achieve both of low temperature fixing ability and hot offset resistance (see, for example, Japanese Patent (JP-B) No. 2579150 and JP-A No. 2001-158819).

These proposed techniques, however, do not attain a high level of low temperature fixing ability that has recently been demanded.

Then, in order to attain a high level of low temperature fixing ability, there are proposed toners containing a resin including a crystalline polyester resin, and a release agent and having a phase separation structure which is a sea-island form where the resin and wax are incompatible to each other (see, for example, JP-A No. 2004-46095).

Also, there is a proposed toner containing a crystalline polyester resin, a release agent, and a graft polymer (see, for example, JP-A No. 2007-271789).

According to these proposed techniques, a crystalline polyester resin more rapidly melts than a non-crystalline polyester resin does, which makes it possible to allow the resultant toner to have a lowered fixing temperature. Thus, it is possible to obtain a toner compatible with low temperature fixing ability and heat resistant storage stability. However, stress applied to the toner in a developing device more increases when it is used in a high-speed device, and generation of the toner aggregation and clogging of a doctor cause problems such as a void of the toner (transfer void) on the area of the outputted toner image. In addition, a toner containing a crystalline polyester resin causes problems such as generation of the toner aggregation under a high temperature and high humidity environment.

Regarding charging performance of a toner, a toner having higher charging ability has been proposed, where the toner contains a layered modified inorganic mineral, and is obtained by washing and removing an organic cation contained in the layered modified inorganic mineral of the toner (see, for example, JP-A No. 2012-118362). However, this method does not exhibit sufficient improving effects of charge rising properties, which causes problems such as toner's background smear (fogging) and toner scattering.

Accordingly, demand has arisen for a toner having low temperature fixing ability and heat resistant storage stability and further having high charging ability.

SUMMARY OF THE INVENTION

The present invention aims to solve the above problems pertinent in the art and to achieve the following object. That is, an object of the present invention is to provide a toner having low temperature fixing ability and heat resistant storage stability, and further having high charging ability.

Means for solving the above problems are as follows.

That is, in a toner of the present invention, an amount of Al detected is 0.7% to 1.3%, where the amount of Al detected is determined based on quantitative analysis of Al by X-ray photoelectron spectroscopic analysis (XPS); and [Tg2nd (THF insoluble matter)] is −40° C. to 30° C., where the [Tg2nd (THF insoluble matter)] is a glass transition temperature measured in second heating of differential scanning calorimetry (DSC) of THF insoluble matter of the toner.

According to the present invention, it is possible to solve the above problems pertinent in the art and to provide a toner having low temperature fixing ability and heat resistant storage stability, and further having high charging ability.

DETAILED DESCRIPTION OF THE INVENTION (Toner)

Figure 1:
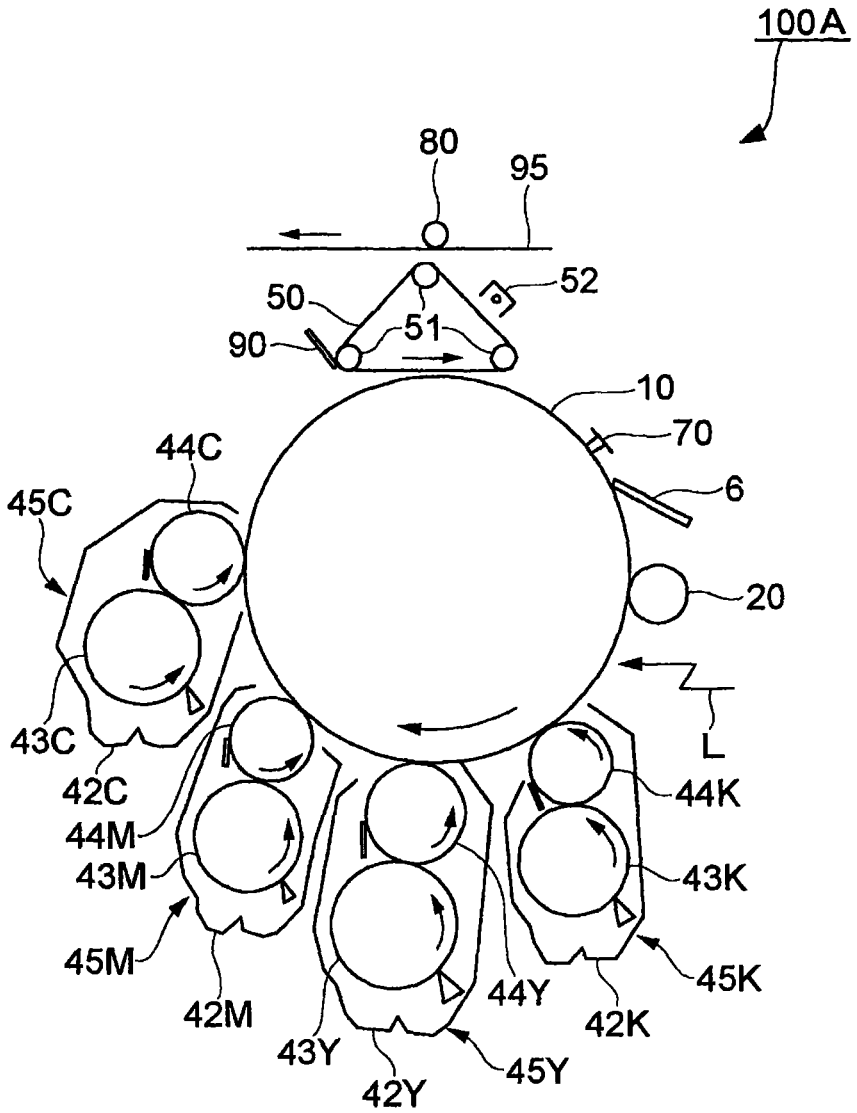
FIG. 1 is a schematic structural view of one example of an image forming apparatus of the present invention.

In a toner of the present invention, an amount of Al detected is 0.7% to 1.3%, where the amount of Al detected is determined based on quantitative analysis of Al by X-ray photoelectron spectroscopic analysis (XPS); and [Tg2nd (THF insoluble matter)] is −40° C. to 30° C., where the [Tg2nd (THF insoluble matter)] is a glass transition temperature measured in second heating of differential scanning calorimetry (DSC) of THF insoluble matter of the toner.

The toner exhibiting the above properties has low temperature fixing ability and heat resistant storage stability, and further has high charging ability.

A toner of the present invention contains a non-crystalline polyester resin, a crystalline polyester resin, and a charge controlling agent, and further contains other components if necessary.

A toner of the present invention can be suitably produced by the production method described hereinafter. Specifically, the toner thereof can be produced by a production method including dispersing an oil phase in organic resin particles-dispersed aqueous medium, where the oil phase is prepared by dissolving or dispersing toner materials in an organic solvent, where the toner materials contain a binder resin component including a non-crystalline polyester resin and a crystalline polyester resin, and a charge controlling agent. In the toner produced by the aforementioned method, the organic resin particles and the charge controlling agent exist near the toner surface. Here, a ratio of the toner surface covered with a charge controlling agent is high, and thus the resultant toner exhibits high charging ability. However, a ratio of the toner surface covered with the organic resin particles and a charge controlling agent is high, and thus the resultant toner is lowered in low temperature fixing ability.

Accordingly, the present inventors removed organic resin particles from the toner surface, and adjusted the amounts of the organic resin particles and a charge controlling agent on the toner surface so that an amount of aluminum originated from the charge controlling agent exhibits a given value, and as a result have found that a toner exhibiting the aforementioned given value is a toner compatible with charging ability and low temperature fixing ability.

<Non-Crystalline Polyester Resin>

The non-crystalline polyester resin is not particularly limited and may be appropriately selected depending on the intended purpose, but it preferably contains a non-linear, non-crystalline polyester resin A and a non-crystalline polyester resin B.

<<Non-Linear, Non-Crystalline Polyester Resin A>>

The non-linear, non-crystalline polyester resin A which constitutes the THF insoluble matter is not particularly limited and may be appropriately selected depending on the intended purpose. It is preferably obtained, for example, by reaction of a non-linear reactive precursor and a curing agent.

The non-linear, non-crystalline polyester resin A is not particularly limited and may be appropriately selected depending on the intended purpose. The non-linear, non-crystalline polyester resin A preferably contains any one of a urethane bond or a urea bond because it is possible to obtain excellent adhesion to recording media such as paper. Also, the non-linear, non-crystalline polyester resin A contains any one of a urethane bond or a urea bond, and thus the urethane bond and the urea bond behave like pseudo-crosslinked points, the non-linear, non-crystalline polyester resin A exhibits stronger rubber-like properties, further improving heat resistant storage stability and high temperature offset resistance of the toner.

Here, "non-linear" means that a compound modified thereby has a branched structure imparted by a trihydric or higher alcohol and/or a trivalent or higher carboxylic acid.

-Non-Linear, Reactive Precursor-

The non-linear, reactive precursor is not particularly limited and may be appropriately selected depending on the intended purpose so long as it is a polyester resin containing a group reactive with the curing agent (hereinafter may be referred to as "prepolymer").

Examples of the group reactive with the curing agent in the prepolymer include a group reactive with an active hydrogen group. Examples thereof include an isocyanate group, an epoxy group, a carboxylic acid group, and an acid chloride group. Among them, the isocyanate group is preferable because it is possible to induce a urethane bond or a urea bond to the non-linear, non-crystalline polyester resin A.

As the prepolymer, an isocyanate group-containing polyester resin is preferable.

--Isocyanate Group-Containing Polyester Resin--

The isocyanate group-containing polyester resin is not particularly limited and may be appropriately selected depending on the intended purpose. Examples thereof include a reaction product between an active hydrogen group-containing polyester resin and a polyisocyanate.

The active hydrogen group-containing polyester resin can be obtained by polycondensation of, for example, diol, dicarboxylic acid and at least one of trihydric or higher alcohol and trivalent or higher carboxylic acid. The trihydric or higher alcohol and the trivalent or higher carboxylic acid give a branch structure to the isocyanate group-containing polyester.

---Diol---

The diol component is not particularly limited and may be appropriately selected depending on the intended purpose. Examples thereof include aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; diols containing an oxyalkylene group such as diethylene glycol, triethylene glycol, dipropylene glycol, polyethylene glycol, polypropylene glycol and polytetramethylene glycol; alicyclic diols such as 1,4-cyclohexane dimethanol and hydrogenated bisphenol A; adducts of alicyclic diols with alkylene oxides such as ethylene oxide, propylene oxide, and butylene oxide; bisphenols such as bisphenol A, bisphenol F and bisphenol S; and adducts of bisphenols with alkylene oxides such as ethylene oxide, propylene oxide, and butylene oxide. Among them, aliphatic diols having 4 to 12 carbon atoms are preferred.

These diols may be used alone or in combination of two or more thereof.

---Dicarboxylic Acid---

The dicarboxylic acid component is not particularly limited and may be appropriately selected depending on the intended purpose. Examples thereof include aliphatic dicarboxylic acids and aromatic dicarboxylic acids. Besides, anhydrides thereof, lower (having 1 to 3 carbon atoms) alkyl-esterified compounds thereof, or halides thereof may also be used.

The aliphatic dicarboxylic acid is not particularly limited and may be appropriately selected depending on the intended purpose. Examples thereof include succinic acid, adipic acid, sebacic acid, decanedioic acid, maleic acid, and fumaric acid.

The aromatic dicarboxylic acid is not particularly limited and may be appropriately selected depending on the intended purpose. Examples thereof include an aromatic dicarboxylic acid having 8 to 20 carbon atoms. Examples of the aromatic dicarboxylic acid having 8 to 20 carbon atoms are not particularly limited and may be appropriately selected depending on the intended purpose. Examples thereof include phthalic acid, isophthalic acid, terephthalic acid, and naphthalene dicarboxylic acid.

Among them, an aliphatic dicarboxylic acids having 4 to 12 carbon atoms are preferable.

These dicarboxylic acids may be used alone or in combination of two or more thereof.

---Trihydric or Higher Alcohol---

The trihydric or higher alcohol is not particularly limited and may be appropriately selected depending on the intended purpose. Examples thereof include trihydric or higher aliphatic alcohols, trivalent or higher polyphenols, and adducts of alkylene oxide with trivalent or higher polyphenols.

Examples of the trihydric or higher aliphatic alcohol include glycerin, trimethylolethane, trimethylolpropane, pentaerythritol, and sorbitol.

Examples of trivalent or higher polyphenols include trisphenol PA, phenol novolak, cresol novolak.

Examples of the adducts of alkylene oxide with trivalent or higher polyphenols include adducts of trivalent or higher polyphenols with alkylene oxides such as ethylene oxide, propylene oxide, and butylene oxide.

---Trivalent or Higher Carboxylic Acid---

The trivalent or higher carboxylic acid is not particularly limited and may be appropriately selected depending on the intended purpose. Examples thereof include trivalent or higher aromatic dicarboxylic acids. Besides, anhydrides thereof, lower (having 1 to 3 carbon atoms) alkyl-esterified compounds thereof, or halides thereof may also be used.

As the trivalent or higher aromatic dicarboxylic acids, trivalent or higher aromatic dicarboxylic acids having 9 to 20 carbon atoms are preferable. Examples of the trivalent or higher aromatic dicarboxylic acids having 9 to 20 carbon atoms are preferable include trimellitic acid and pyromellitic acid.

---Polyisocyanate---

The polyisocyanate is not particularly limited and may be appropriately selected depending on the intended purpose. Examples thereof include diisocyanate, and trivalent or higher isocyanate.

Examples of the diisocyanate include: aliphatic diisocyanate; alicyclic diisocyanate; aromatic diisocyanate; aromatic aliphatic diisocyanate; isocyanurate; and a block product thereof where the foregoing compounds are blocked with a phenol derivative, oxime, or caprolactam.

The aliphatic diisocyanate is not particularly limited and may be appropriately selected depending on the intended purpose. Examples thereof include tetramethylene diisocyanate, hexamethylene diisocyanate, 2,6-diisocyanato methyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly limited and may be appropriately selected depending on the intended purpose. Examples thereof include isophorone diisocyanate, and cyclohexylmethane diisocyanate.

The aromatic diisocyanate is not particularly limited and may be appropriately selected depending on the intended purpose. Examples thereof include tolylene diisocyanate, diisocyanato diphenyl methane, 1,5-nephthylene diisocyanate, 4,4'-diisocyanato diphenyl, 4,4'-diisocyanato-3,3'-dimethyldiphenyl, 4,4'-diisocyanato-3-methyldiphenyl methane, and 4,4'-diisocyanato-diphenyl ether.

The aromatic aliphatic diisocyanate is not particularly limited and may be appropriately selected depending on the intended purpose. Examples thereof include $\alpha,\alpha,\alpha',\alpha'$-tetramethylxylene diisocyanate.

The isocyanurate is not particularly limited and may be appropriately selected depending on the intended purpose. Examples thereof include tris(isocyanatoalkyl)isocyanurate, and tris(isocyanatocycloalkyl)isocyanurate.

These polyisocyanates may be used alone or in combination of two or more thereof.

-Curing Agent-

The curing agent is not particularly limited and may be appropriately selected depending on the intended purpose so long as it reacts with the non-linear, reactive precursor, and produces the non-linear, non-crystalline polyester resin A. Examples thereof include an active hydrogen group-containing compound.

---Active Hydrogen Group-Containing Compound---

An active hydrogen group in the active hydrogen group-containing compound is not particularly limited and may be appropriately selected depending on the intended purpose. Examples thereof include a hydroxyl group (e.g., an alcoholic hydroxyl group, and a phenolic hydroxyl group), an amino group, a carboxyl group, and a mercapto group. These may be used alone or in combination of two or more thereof.

The active hydrogen group-containing compound is not particularly limited and may be appropriately selected depending on the intended purpose, but it is preferably selected from amines, as the amines can form a urea bond.

The amines are not particularly limited and may be appropriately selected depending on the intended purpose. Examples thereof include diamine, trivalent or higher amine, amino alcohol, amino mercaptan, amino acid, and compounds in which the amino groups of the foregoing compounds are blocked. These may be used alone or in combination of two or more thereof.

Among them, diamine, and a mixture of diamine and a small amount of trivalent or higher amine are preferable.

The diamine is not particularly limited and may be appropriately selected depending on the intended purpose. Examples thereof include aromatic diamine, alicyclic diamine, and aliphatic diamine. The aromatic diamine is not particularly limited and may be appropriately selected depending on the intended purpose. Examples thereof include phenylenediamine, diethyl toluene diamine, and 4,4'-diaminodiphenylmethane. The alicyclic diamine is not particularly limited and may be appropriately selected depending on the intended purpose. Examples thereof include 4,4'-diamino-3,3'-dimethyldicyclohexyl methane, diamino cyclohexane, and isophoronediamine. The aliphatic diamine is not particularly limited and may be appropriately selected depending on the intended purpose. Examples thereof include ethylene diamine, tetramethylene diamine, and hexamethylenediamine.

The trivalent or higher amine is not particularly limited and may be appropriately selected depending on the intended purpose. Examples thereof include diethylenetriamine, and triethylene tetramine.

The amino alcohol is not particularly limited and may be appropriately selected depending on the intended purpose. Examples thereof include ethanol amine, and hydroxyethyl aniline.

The aminomercaptan is not particularly limited and may be appropriately selected depending on the intended purpose. Examples thereof include aminoethyl mercaptan, and aminopropyl mercaptan.

The amino acid is not particularly limited and may be appropriately selected depending on the intended purpose. Examples thereof include aminopropionic acid, and aminocaproic acid.

The compound where the amino group is blocked is not particularly limited and may be appropriately selected depending on the intended purpose. Examples thereof include a ketimine compound where the amino group is blocked with ketone such as acetone, methyl ethyl ketone, methyl isobutyl ketone, and an oxazoline compound.

The non-linear, non-crystalline polyester resin A preferably satisfies any one of the following (a) to (c) in order to lower Tg thereof and in order to easily impart a property of deforming at a low temperature.

(a) The non-linear, non-crystalline polyester resin A contains a diol component as the constituent component thereof, where the diol component preferably contains an aliphatic diol having 4 to 12 carbon atoms in an amount of 50% by mass or more.

(b) The non-linear, non-crystalline polyester resin A preferably contains an aliphatic diol having 4 to 12 carbon atoms in an amount of 50% by mass or more of the total alcohol components.

(c) The non-linear, non-crystalline polyester resin A contains a dicarboxylic acid component as the constituent component thereof, where the dicarboxylic acid preferably contains an aliphatic diol having 4 to 12 carbon atoms in an amount of 50% by mass or more.

A Tg (1st) of the non-linear, non-crystalline polyester resin A is −60° C. to 0° C., more preferably −40° C. to −20° C. When the Tg (1st) thereof is less than −60° C., the flow of the toner can not be inhibited, and thus heat resistant storage stability of the toner and filming resistance may be impaired. When the Tg (1st) thereof is more than 0° C., the deformation of the toner with heat and pressurization during fixing is insufficient, which lead to insufficient low temperature fixing ability of the toner.

A weight average molecular weight of the non-linear, non-crystalline polyester resin A is not particularly limited and may be appropriately selected depending on the intended purpose. As measured by GPC (gel permeation chromatography), the weight average molecular weight thereof is preferably 10,000 to 100,000. When the weight average molecular weight thereof is less than 10,000, the resulting toner easily flows at a low temperature, which may deteriorate heat resistant storage stability. In addition, a viscosity of the resulting toner may lower during melting, which may impair high temperature offset property. When the weight average molecular weight thereof is more than 100,000, the Tg of the toner may be increased, and high temperature offset property of the toner may be deteriorated.

A molecular structure of the non-linear, non-crystalline polyester resin A can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-linear, non-crystalline polyester resin A is not particularly limited and may be appropriately selected depending on the intended purpose, but it is preferably 5 parts by mass to 25 parts by mass, more preferably 10 parts by mass to 20 parts by mass, relative to 100 parts by mass of the toner. When the amount thereof is less than 5 parts by mass, low temperature fixing ability, and hot offset resistance of a resulting toner may be impaired. When the amount thereof is more than 25 parts by mass, heat resistant storage stability of the toner may be impaired, and glossiness of an image obtained after fixing may be reduced. When the amount thereof is within the aforementioned more preferable range, it is advantageous because the resultant toner is excellent in all of the low temperature fixing ability, hot offset resistance, and heat resistant storage stability.

<<Non-Crystalline Polyester Resin B>>

A glass transition temperature (Tg) of the non-crystalline polyester resin B is not particularly limited and may be appropriately selected depending on the intended purpose so long as it is 40° C. to 80° C.

As the non-crystalline polyester resin B, an unmodified polyester resin is preferable. The unmodified polyester resin is a polyester resin obtained by using polyhydric alcohol, and multivalent carboxylic acids such as multivalent carboxylic acid, multivalent carboxylic acid anhydride, multivalent carboxylic acid ester, or derivatives thereof, and is a polyester resin which is not modified by isocyanate compounds and the like.

Examples of the polyhydric alcohol include diol.

The diol include alkylene (having 2 to 3 carbon atoms) oxide (average addition molar number is 1 to 10) adduct of bisphenol A such as polyoxypropylene(2.2)-2,2-bis(4-hydroxyphenyl)propane, and polyoxyethylene(2.2)-2,2-bis(4-hydroxyphenyl)propane; ethylenegrycol, propylenegrycol; and hydrogenated bisphenol A, and alkylene (having 2 to 3 carbon atoms) oxide (average addition molar number is 1 to 10) adduct of hydrogenated bisphenol A.

These may be used alone or in combination of two or more thereof.

Examples of the multivalent carboxylic acid include dicarboxylic acid.

Examples of the dicarboxylic acid include: adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid and octylsuccinic acid.

These may be used alone or in combination of two or more thereof.

The non-crystalline polyester resin B may contain at least one of a trivalent or higher carboxylic acid and a trivalent or higher alcohol at the end of the resin chain in order to adjust an acid value and a hydroxyl value.

Examples of the trivalent or higher carboxylic acid include trimellitic acid, pyromellitic acid, and acid anhydride thereof.

Examples of the trihydric or higher alcohol include glycerin, pentaerythritol, and trymethylol propane.

A molecular weight of the non-crystalline polyester resin B is not particularly limited and may be appropriately selected depending on the intended purpose. However, when the molecular weight thereof is too low, heat resistant storage stability of the toner and durability against stress such as stirring in the developing unit may be deteriorated. When the molecular weight thereof is too high, viscoelasticity of the toner during melting may be high, which may deteriorate low temperature fixing ability. Thus, a weight average molecular weight (Mw) is preferably 3,000 to 10,000 as measured by GPC (gel permeation chromatography). A number average molecular weight (Mn) is preferably 1,000 to 4,000. Moreover, Mw/Mn is preferably 1.0 to 4.0.

The weight average molecular weight (Mw) is more preferably 4,000 to 7,000. The number average molecular weight (Mn) is more preferably 1,500 to 3,000. The Mw/Mn is more preferably 1.0 to 3.5.

The acid value of the non-crystalline polyester resin B is not particularly limited and may be appropriately selected depending on the intended purpose. The acid value thereof is preferably 1 mg to 50 mg KOH/g, more preferably 5 mg to 30 mg KOH/g. When the acid value is 1 mg KOH/g or more, a resulting toner is likely to be negatively charged. In addition, a resulting toner has good affinity between the paper and the toner when fixed on the paper, which may improve low temperature fixing ability. Meanwhile, when the acid value is more than 50 mg KOH/g, a resulting toner may deteriorate charging stability, especially charging stability against environmental change.

The hydroxyl value of the non-crystalline polyester resin B is not particularly limited and may be appropriately selected depending on the intended purpose. The hydroxyl value thereof is preferably 5 mg KOH/g or more.

A glass transition temperature (Tg) of the non-crystalline polyester resin B is preferably 40° C. to 80° C., more preferably 50° C. to 70° C. When the Tg thereof is less than 40° C., a resulting toner may have low heat resistant storage stability, low durability against stress such as stirring in the developing unit, and filming resistance of the toner may be deteriorated. Meanwhile, when the glass transition temperature is more than 80° C., the deformation of the toner with heat and pressurization during fixing may be insufficient, which leads to insufficient low temperature fixing ability.

A molecular structure of the non-crystalline polyester resin B can be confirmed by solution-state or solid-state NMR, X-ray diffraction, GC/MS, LC/MS, or IR spectroscopy. Simple methods thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the non-crystalline polyester resin B is not particularly limited and may be appropriately selected depending on the intended purpose, but it is preferably 50 parts by mass to 90 parts by mass, more preferably 60 parts by mass to 80 parts by mass, relative to 100 parts by mass of the toner. When the amount thereof is less than 50 parts by mass, dispersibility of the pigment and the release agent in the toner may be deteriorated, and fogging and artifact of an image may be caused. Meanwhile, when the amount thereof is more than 90 parts by mass, the amount of the crystalline polyester resin C and the non-linear, non-crystalline polyester resin A are low, which may deteriorate low temperature fixing ability. When the amount thereof is within more preferable range than the aforementioned range, it is advantageous because a resulting toner is excellent in terms of both high image quality and low temperature fixing ability.

<<Crystalline Polyester Resin C>>

The crystalline polyester resin C has high crystallinity, and thus, exhibits heat melting characteristics that a drastic drop in a viscosity takes place at a temperature around fixing onset temperature. By using the crystalline polyester resin C having heat melting characteristics together with the non-crystalline polyester resin B, the heat resistant storage stability of the toner is excellent up to the melt onset temperature owing to crystallinity, and the toner drastically decreases its viscosity (sharp melt properties) at the melt onset temperature because of melting of the crystalline polyester resin C. Along with the drastic decrease in viscosity, the crystalline polyester resin C is melt together with the non-crystalline polyester resin B described hereinafter, to drastically decrease their viscosity to thereby be fixed. Accordingly, a toner having excellent heat resistant storage stability and low temperature fixing ability can be obtained. Moreover, the toner has excellent results in terms of a releasing width (a difference between the minimum fixing temperature and hot offset occurring temperature).

The crystalline polyester resin C, as described above, can be obtained by using a polyhydric alcohol and a multivalent carboxylic acid or a derivative thereof such as a multivalent carboxylic acid anhydride and a multivalent carboxylic acid ester.

Note that, in the present invention, the crystalline polyester resin C is one obtained from a polyhydric alcohol and a multivalent carboxylic acid or a derivative thereof such as a multivalent carboxylic acid anhydride and a multivalent carboxylic acid ester, as described above, and a resin obtained by modifying a polyester resin, for example, the aforementioned prepolymer and a resin obtained through cross-link and/or chain elongation reaction of the prepolymer do not belong to the crystalline polyester resin C.

-Polyhydric Alcohol-

The polyhydric alcohol is not particularly limited and may be appropriately selected depending on the intended purpose.

Examples thereof include diol, and trihydric or higher alcohol. Examples of the diol include saturated aliphatic diol. Examples of the saturated aliphatic diol include straight chain saturated aliphatic diol, and branched-chain saturated aliphatic diol. Among them, straight chain saturated aliphatic diol is preferable, and straight chain saturated aliphatic diol having 2 to 12 carbon atoms is more preferable. When the saturated aliphatic diol has a branched-chain structure, crystallinity of the crystalline polyester resin C may be low, and thus may lower the melting point. When the number of carbon atoms in the saturated aliphatic diol is more than 12, it may be difficult to yield a material in practice. The number of carbon atoms is therefore preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, ethylene glycol, 1,4-butanediol, 1,6-hexanediol, 1,8-octanediol, 1,10-decanediol, and 1,12-dodecanediol are preferable, as they give high crystallinity to a resulting crystalline polyester resin C, and give excellent sharp melt properties.

Examples of the trihydric or higher alcohol include glycerin, trimethylol ethane, trimethylolpropane, and pentaerythritol.

These may be used alone or in combination of two or more thereof.

-Multivalent Carboxylic Acid-

The multivalent carboxylic acid is not particularly limited and may be appropriately selected depending on the intended purpose. Examples thereof include divalent carboxylic acid, and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acid of dibasic acid, such as phthalic acid, isophthalic acid, terephthalic acid, naphthalene-2,6-dicarboxylic acid, malonic acid, and mesaconic acid; and anhydrides of the foregoing compounds, and lower (having 1 to 3 carbon atoms) alkyl ester of the foregoing compounds.

Examples of the trivalent or higher carboxylic acid include 1,2,4-benzenetricarboxylic acid, 1,2,5-benzenetricarboxylic acid, 1,2,4-naphthalene tricarboxylic acid, anhydrides thereof, and lower (having 1 to 3 carbon atoms) alkyl esters thereof.

Moreover, the multivalent carboxylic acid may contain, other than the saturated aliphatic dicarboxylic acid or aromatic dicarboxylic acid, dicarboxylic acid containing a sulfonic acid group. Further, the multivalent carboxylic acid may contain, other than the saturated aliphatic dicarboxylic acid or aromatic dicarboxylic acid, dicarboxylic acid having a double bond.

These may be used alone or in combination of two or more thereof.

The crystalline polyester resin C is preferably composed of a straight chain saturated aliphatic dicarboxylic acid having 4 to 12 carbon atoms and a straight chain saturated aliphatic diol having 2 to 12 carbon atoms. Specifically, the crystalline polyester resin C preferably contains a constituent unit derived from a saturated aliphatic dicarboxylic acid having 4 to 12 carbon atoms, and a constituent unit derived from a saturated aliphatic diol having 2 to 12 carbon atoms. As a result of this, crystallinity increases, and sharp melt properties improve, and therefore it is preferable as excellent low temperature fixing ability of the toner is exhibited.

A melting point of the crystalline polyester resin C is not particularly limited and may be appropriately selected depending on the intended purpose, but it is preferably 60° C. to 80° C. When the melting point thereof is lower than 60° C., the crystalline polyester resin C tends to be melted at low temperature, which may impair heat resistant storage stability of the toner. When the melting point thereof is higher than 80° C., melting of the crystalline polyester resin C with heat applied during fixing may be insufficient, which may impair low temperature fixing ability of the toner.

A molecular weight of the crystalline polyester resin C is not particularly limited and may be appropriately selected depending on the intended purpose. Since those having a sharp molecular weight distribution and low molecular weight have excellent low temperature fixing ability, and heat resistant storage stability of a resulting toner lowers as an amount of a low molecular weight component, an o-dichlorobenzene soluble component of the crystalline polyester resin C preferably has the weight average molecular weight (Mw) of 3,000 to 30,000, number average molecular weight (Mn) of 1,000 to 10,000, and Mw/Mn of 1.0 to 10, as measured by GPC.

Further, it is more preferred that the weight average molecular weight (Mw) thereof be 5,000 to 15,000, the number average molecular weight (Mn) thereof be 2,000 to 10,000, and the Mw/Mn be 1.0 to 5.0.

An acid value of the crystalline polyester resin C is not particularly limited and may be appropriately selected depending on the intended purpose, but it is preferably 5 mg KOH/g or higher, more preferably 10 mg KOH/g or higher for achieving the desired low temperature fixing ability in view of affinity between paper and the resin. Meanwhile, the acid value thereof is preferably 45 mg KOH/g or lower for the purpose of improving hot offset resistance.

A hydroxyl value of the crystalline polyester resin C is not particularly limited and may be appropriately selected depending on the intended purpose, but it is preferably 0 mg KOH/g to 50 mg KOH/g, more preferably 5 mg KOH/g to 50 mg KOH/g, for achieving the desired low temperature fixing ability and excellent charging properties.

A molecular structure of the crystalline polyester resin C can be confirmed by solution-state or solid-state NMR, X-ray diffraction, GC/MS, LC/MS, or IR spectroscopy. Simple methods thereof include a method for detecting, as the crystalline polyester resin C, one that has absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

An amount of the crystalline polyester resin C is not particularly limited and may be appropriately selected depending on the intended purpose, but it is preferably 3 parts by mass to 20 parts by mass, more preferably 5 parts by mass to 15 parts by mass, relative to 100 parts by mass of the toner. When the amount thereof is less than 3 parts by mass, the crystalline polyester resin C does not give sufficient sharp melt properties, which may lead to insufficient low temperature fixing ability of a resulting toner. When the amount thereof is more than 20 parts by mass, a resulting toner may have low heat resistant storage stability, and tends to cause fogging of an image. When the amount thereof is within the aforementioned more preferable range, it is advantageous because a resulting toner is excellent in terms of both high image quality and low temperature fixing ability.

<Charge Controlling Agent>

The charge controlling agent preferably contains a modified layered inorganic mineral in which at least one of a metal cation is ion-exchanged with an organic cation.

The modified layered inorganic mineral is more preferably an organic modified smectite in which a part of metal cation of the layered inorganic mineral having a smectite-based basic crystal structure is ion-exchanged with an organic cation. Thus, a shape of toner base particles can be controlled, which can improve charging performance of the toner.

The layered inorganic mineral is not particularly limited and may be appropriately selected depending on the intended purpose. Examples thereof include montmorillonite, bentonite, beidellite, nontronite, saponite, and hectorite. These may be used in combination of two or more thereof.

The organic cation is not particularly limited and may be appropriately selected depending on the intended purpose. Examples thereof include a quaternary ammonium ion, a phosphonium ion, and an imidazolium ion. Among them, an ammonium ion is preferable.

The quaternary ammonium ion is not particularly limited and may be appropriately selected depending on the intended purpose. Examples thereof include a trimethyl stearyl ammonium ion, a dimethyl stearyl benzyl ammonium ion, a dimethyl octadecyl ammonium ion, and an oleyl bis(2-hydroxyethyl)methyl ammonium ion.

Examples of the commercially available products of the organic modified smectite include BENTONE 34, BENTONE 52, BENTONE 38, BENTONE 27, BENTONE 57, BENTONE SD1, BENTONE SD2, and BENTONE SD3 (all products are ELEMENTIS); CRAYTONE 34, CRAYTONE 40, CRAYTONE HT, CRAYTONE 2000, CRAYTONE AF, CRAYTONE APA, and CRAYTONE HY (all products are SCP); S-BEN, S-BEN E, S-BEN C, S-BEN NZ, S-BEN NZ70, S-BEN W, S-BEN N400, S-BEN NX, S-BEN NX80, S-BEN NO12S, S-BEN NEZ, S-BEN NO12, S-BEN WX, and S-BEN NE (all products are HOJUN); and KUNIBIS 110, KUNIBIS 120, and KUNIBIS 127 (all products are KUNIMINE INDUSTRIES CO., LTD.).

An amount of the organic modified smectite in the toner base particles is preferably 0.1% by mass to 5% by mass. When the amount thereof is less than 0.1%, the effect on the charging performance of the toner may be lowered. When the amount thereof is more than 5% by mass, the toner may be deteriorated in fixing ability.

<Other Components>

Besides the aforementioned components, a toner of the present invention can contain a release agent, a colorant, an external additive, a flow improving agent, a cleaning improving agent, and a magnetic material, if necessary.

<<Release Agent>>

The release agent is appropriately selected from those known in the art without any limitation.

Examples of wax serving as the release agent include: natural wax, such as vegetable wax (e.g., carnauba wax, cotton wax, Japan wax and rice wax), animal wax (e.g., bees wax and lanolin), mineral wax (e.g., ozokelite and ceresine) and petroleum wax (e.g., paraffin wax, microcrystalline wax and petrolatum).

Examples of the wax other than the above natural wax include synthetic hydrocarbon wax (e.g., Fischer-Tropsch wax and polyethylene wax; and synthetic wax (e.g., ester wax, ketone wax and ether wax).

Further, other examples of the release agent include fatty acid amides such as 12-hydroxystearic acid amide, stearic amide, phthalic anhydride imide and chlorinated hydrocarbons; low-molecular-weight crystalline polymers such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain.

Among them, hydrocarbon wax, such as paraffin wax, microcrystalline wax, Fischer-Tropsch wax, polyethylene wax, and polypropylene wax, is preferable.

A melting point of the release agent is not particularly limited and may be appropriately selected depending on the intended purpose, but it is preferably 60° C. to 80° C. When the melting point thereof is lower than 60° C., the release agent tends to melt at low temperature, which may impair heat resistant storage stability. When the melting point thereof is higher than 80° C., the release agent is not sufficiently melted to thereby cause fixing offset even in the case where the resin is melted and is in the fixing temperature range, which may cause defects in an image.

An amount of the release agent is appropriately selected depending on the intended purpose without any limitation, but it is preferably 2 parts by mass to 10 parts by mass, more preferably 3 parts by mass to 8 parts by mass, relative to 100 parts by mass of the toner. When the amount thereof is less than 2 parts by mass, a resulting toner may have insufficient hot offset resistance, and low temperature fixing ability during fixing. When the amount thereof is more than 10 parts by mass, a resulting toner may have insufficient heat resistant storage stability, and tends to cause fogging in an image. When the amount thereof is within the aforementioned more preferable range, it is advantageous because image quality and fixing stability can be improved.

<<Colorant>>

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazine lake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Hello Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is not particularly limited and may be appropriately selected depending on the intended purpose, but it is preferably 1 part by mass to 15 parts by mass, more preferably 3 parts by mass to 10 parts by mass, relative to 100 parts by mass of the toner.

The colorant may be used as a master batch in which the colorant forms a composite with a resin. Examples of the binder resin kneaded in the production of, or together with the master batch include, other than the aforementioned non-crystalline polyester resin B, polymer of styrene or substitution thereof (e.g., polystyrene, poly-p-chlorostyrene, and polyvinyl); styrene copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer); and others including polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, a terpene resin, an aliphatic or alicyclic hydrocarbon resin, an aromatic petroleum resin, chlorinated paraffin, and paraffin wax. These may be used alone or in combination.

The master batch can be prepared by mixing and kneading the colorant with the resin for the master batch. In the mixing and kneading, an organic solvent may be used for improving the interactions between the colorant and the resin. Moreover, the master batch can be prepared by a flashing method in which an aqueous paste containing a colorant is mixed and kneaded with a resin and an organic solvent, and then the colorant is transferred to the resin to remove the water and the organic solvent. This method is preferably used because a wet cake of the colorant is used as it is, and it is not necessary to dry the wet cake of the colorant to prepare a colorant. In the mixing and kneading of the colorant and the resin, a high-shearing disperser (e.g., a three-roll mill) is preferably used.

<<External Additive>>

As for the external additive, other than oxide particles, a combination of inorganic particles and hydrophobic-treated inorganic particles can be used. The average primary particle diameter of the hydrophobic-treated particles is preferably 1 nm to 100 nm, more preferably More preferred are the inorganic particles having an average primary particle diameter of 5 nm to 70 nm.

Moreover, it is preferred that the external additive contain at least one type of hydrophobic-treated inorganic particles having the average primary particle diameter of 20 nm or less, and at least one type of inorganic particles having the average primary particle diameter of 30 nm or more. Moreover, the external additive preferably has a surface area of 20 $m^2/g$ to 500 $m^2/g$ based on BET method.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, R974, RX200, RY200, R202, R805, and R812 (all products of Nippon Aerosil Co., Ltd.). Examples of the titania particles include P-25 (product of Nippon Aerosil Co., Ltd.); STT-30, STT-65C-S (both products of Titan Kogyo, Ltd.); TAF-140 (product of Fuji Titanium Industry Co., Ltd.); and MT-150W, MT-500B, MT-600B, MT-150A (all product of TAYCA CORPORATION).

Examples of the hydrophobic-treated titanium oxide particles include: T-805 (product of Nippon Aerosil Co., Ltd.); STT-30A, STT-65S-S (both products of Titan Kogyo, Ltd.); TAF-500T, TAF-1500T (both products of Fuji Titanium Industry Co., Ltd.); MT-100S, MT-100T (both products of TAYCA CORPORATION); and IT-S (product of ISHIHARA SANGYO KAISHA, LTD.).

The hydrophobic-treated oxide particles, hydrophobic-treated silica particles, hydrophobic-treated titania particles, and hydrophobic-treated alumina particles are obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium dioxide are preferable.

An amount of the external additive is not particularly limited and may be appropriately selected depending on the intended purpose, but it is preferably 0.1 parts by mass to 5 parts by mass, more preferably 0.3 parts by mass to 3 parts by mass, relative to 100 parts by mass of the toner.

The average particle diameter of primary particles of the inorganic particles is not particularly limited and may be appropriately selected depending on the intended purpose, but it is preferably 100 nm or less, more preferably 3 nm to 70 nm. When it is less than 3 nm, the inorganic particles are embedded in the toner particles, and therefore the function of the inorganic particles may not be effectively exhibited. When the average particle diameter thereof is more than 70 nm, the inorganic particles may unevenly damage a surface of a photoconductor, and hence not preferable.

<<Flowability Improving Agent>>

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or titanium oxide of the external additive be used as hydrophobic silica or hydrophobic titanium oxide treated with the aforementioned flow improving agent.

<<Cleanability Improving Agent>>

The cleanability improving agent is not particularly limited and may be appropriately selected depending on the intended purpose so long as it can be added to the toner for the purpose of removing the developer remained on a photoconductor or primary transfer member after transferring. Examples thereof include: fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 μm to 1 μm are preferably used.

<<Magnetic Material>>

The magnetic material is not particularly limited and may be appropriately selected depending on the intended purpose. Examples thereof include iron powder, magnetite, and ferrite. Among them, a white magnetic material is preferable in terms of a color tone.

<Property of Toner>

An amount of Al detected in the toner is 0.7% to 1.3%, where the amount of Al detected is determined based on quantitative analysis of Al by X-ray photoelectron spectroscopic analysis (XPS). Here, the amount thereof is more than 1.3%, the toner may be deteriorated in low temperature fixing ability. When it is less than 0.7%, the toner may be insufficient in charging ability.

[Tg2nd (THF insoluble matter)] is −40° C. to 30° C., where the [Tg2nd (THF insoluble matter)] is a glass transition temperature measured in second heating of differential scanning calorimetry (DSC) of THF insoluble matter of the toner.

A toner of the present invention tends to have a lower Tg than the conventional toners, but ensure heat resistant storage stability by containing the THF insoluble matter in the toner. The THF insoluble matter contains the non-linear, non-crystalline polyester resin A as a main component. In particular, when the non-linear, non-crystalline polyester resin A contains a urethane bond or a urea bond responsible for high aggregation force, the resultant toner may exhibit more excellent effects in heat resistant storage stability.

A ratio of the THF insoluble matter in the toner is not particularly limited and may be appropriately selected depending on the intended purpose, but it is preferably 15% by mass to 35% by mass, more preferably 20% by mass to 30% by mass. When the ratio thereof is less than 15% by mass, the resultant toner may be lowered in low temperature fixing ability. When the ratio thereof is more than 35% by mass, the resultant toner may be deteriorated in heat resistant storage stability.

As mentioned above, the [Tg2nd (THF insoluble matter)] may be −40° C. to 30° C., and is preferably 0° C. to 20° C. When the [Tg2nd (THF insoluble matter)] is less than −40° C., heat resistant storage stability of the toner may be deteriorated. When it is more than 30° C. or more, low temperature fixing ability of the toner may be lowered.

The [Tg2nd (THF insoluble matter)] greatly depends on the Tg2nd of the non-linear, non-crystalline polyester resin A.

The [Tg2nd (THF insoluble matter)] falling within the aforementioned range is advantageous for low temperature fixing ability.

The [Tg2nd (THF insoluble matter)] can be adjusted by changing, for example, the resin composition (i.e., by selecting bi- or more functional polyol and/or bi- or more functional acid component).

Specifically, in order to lower the Tg, a polyol having an alkyl group in a side chain as a constituent component on the resin, may be used. In order to increase the Tg, a distance of the ester bond in the resin is shorten.

[Tg1st (toner)] is not particularly limited and may be appropriately selected depending on the intended purpose, where the [Tg1st (toner)] is a glass transition temperature measured in first heating of differential scanning calorimetry (DSC) of the toner. It is preferably 20° C. to 50° C. from the view point of low temperature fixing ability.

In a conventional toner, when a Tg thereof is about 50° C., the conventional toner tends to cause aggregation of toner particles because it is influenced by temperature variations during transportation or storage of the toner in summer or in a tropical region. As a result, the toner is solidified in a toner bottle, or within a developing unit. Moreover, supply failures due to clogging of the toner in the toner bottle, and formation of defected images due to toner adherence easily arise.

Even if the toner has a lower Tg than conventional toners, it can maintain its heat resistant storage stability, because the non-linear, non-crystalline polyester resin A, which is a low Tg component in the toner, is non-linear. In particular, when the non-linear, non-crystalline polyester resin A has a urethane bond or a urea bond responsible for high aggregation force, the effect of retaining heat resistant storage stability will be more significant.

When the [Tg1st (toner)] is lower than 20° C., heat resistant storage stability of the toner may be lowered, and blocking within a developing unit and filming on a photoconductor may be caused. When it is higher than 50° C., low temperature fixing ability of the toner is insufficient. [Tg2nd (THF insoluble matter)] is not particularly limited and may be appropriately selected depending on the intended purpose, where the [Tg2nd (THF insoluble matter)] is a glass transition temperature measured in second heating of differential scanning calorimetry (DSC) of THF insoluble matter of the toner. It is preferably 0° C. or more to 30° C. or less, more preferably 10° C. or more to 25° C. or less.

When the [Tg2nd (toner)] is less than 0° C., heat resistant storage stability of the toner is lowered, and blocking within a developing unit and filming on a photoconductor may be caused. When it is 30° C. or more, the toner is deteriorated in low temperature fixing ability.

[[Tg1st (toner)]−[Tg2nd (toner)]] is not particularly limited and may be appropriately selected depending on the intended purpose, where the [[Tg1st (toner)]−[Tg2nd (toner)]] is a difference between [Tg1st (toner)] and [Tg2nd (toner)], where the [Tg1st (toner)] is a glass transition temperature measured in first heating of differential scanning calorimetry (DSC) of the toner, and the [Tg2nd (toner)] is a glass transition temperature measured in second heating of differential scanning calorimetry (DSC) of the toner. The difference is preferably 10° C. or more in terms of excellent low temperature fixing ability. When the difference is 10° C. or more, the resultant toner is advantageous because it is excellent in low temperature fixing ability. The difference [[Tg1st (toner)]−[Tg2nd (toner)]] of 10° C. or more means that the crystalline polyester resin C is non-compatible state with the non-linear, non-crystalline polyester resin A and the non-crystalline polyester resin B before heating (before the first heating), and then they become a compatible state after heating (after the first heating). Note that, the compatible state after heating may not be a complete compatible state. The upper limit of the difference is not particularly limited and may be appropriately selected depending on the intended purpose, but it is preferably 50° C. or less.

A melting point of the toner is not particularly limited and may be appropriately selected depending on the intended purpose. It is preferably 60° C. to 80° C.

The volume average particle diameter of the toner is not particularly limited and may be appropriately selected depending on the intended purpose, but it is preferably 3 μm to 7 μm. Moreover, a ratio of the volume average particle diameter to the number average particle diameter is preferably 1.2 or less. Further, the toner preferably contains toner particles having the volume average particle diameter of 2 μm or less, in an amount of 1% by number to 10% by number.

<<THF Insoluble Matter>>

The THF insoluble matter of the toner can be obtained as follows.

The toner (1 part) is added to 40 parts of tetrahydrofuran (THF), and the resultant mixture was refluxed for 6 hours. Then, an insoluble matter in the resultant mixture is allowed to precipitate by a centrifugal separator, and is separated into an insoluble component and a supernatant.

The insoluble component is dried at 40° C. for 20 hours, to thereby obtain THF insoluble matter.

Note that, the solvent is removed from the supernatant, followed by drying at 40° C. for 20 hours, to thereby obtain THF soluble matter.

<Calculation Methods and Analysis Methods of Various Properties of Toner and Constituent Component of Toner>

Various physical properties of the non-linear, non-crystalline polyester resin A, the non-crystalline polyester resin B, the crystalline polyester resin C, and the release agent may be each measured. Alternatively, each component may be separated from an actual toner by gel permeation chromatography (GPC) or the like, and separated each component may be subjected to the analysis methods described later, to thereby determine physical properties such as Tg, molecular weight, and melting point, and mass ratio of a constituent component.

Separation of each component by GPC can be performed, for example, by the following method.

In GPC using THF (tetrahydrofuran) as a mobile phase, an eluate is subjected to fractionation by a fraction collector, a fraction corresponding to a part of a desired molecular weight is collected from a total area of an elution curve.

The combined eluate is concentrated and dried by an evaporator or the like, and a resulting solid content is dissolved in a deuterated solvent, such as deuterated chloroform, and deuterated THF, followed by measurement of $^{1}$H-NMR. From an integral ratio of each element, a ratio of a constituent monomer of the resin in the elution composition is calculated.

As another method, after concentrating the eluate, hydrolysis is performed with sodium hydroxide or the like, and a ratio of a constituent monomer is calculated by subjecting the decomposed product to a qualitative and quantitative analysis by high performance liquid chromatography (HPLC).

Note that, in the case where the method for producing a toner produces toner base particles by generating the non-crystalline polyester resin through a chain-elongation reaction and/or crosslink reaction of the non-linear chain reactive precursor and the curing agent, the non-crystalline polyester resin may be separated from an actual toner by GPC or the like, to thereby determine Tg thereof. Alternatively, a polyester resin is separately generated through a chain-elongation reaction and/or crosslink reaction of the non-linear chain reactive precursor and the curing agent, and Tg may be measured on the synthesized non-crystalline polyester resin.

<Separation Unit for Toner Constituent Components, and Measurements of Molecular Weight and Molecular Weight Distribution>

A measuring device, HLC-8020GPC (product of TOSOH CORPORATION) is used. A column of the measuring device is used by connecting three columns (TSKgel Super HZM-H). The measurements are conducted as follows.

The column is stabilized in a heat chamber having a temperature of 40° C. THF as a solvent is flowed at a flow rate of 0.35 mL/min, followed by charging 10 μL of the toner or the resin containing THF sample solution prepared to have a sample concentration of 0.05% by mass to 0.6% by mass with the columns having a temperature of 40° C.

In measuring weight average molecular weight (Mw) and molecular weight distribution, the molecular weight distribution having the sample are calculated based on the relationship between the logarithmic value and the count number of a calibration curve given by using several monodisperse polystyrene-standard samples.

As the standard polystyrene samples used for giving the calibration curve, Showdex STANDARD series having a Mp of 6540000, 3570000, 651000, 251000, 110000, 45000, 19300, 6700, 2800, 580 (these products are of SHOWA DENKO K.K.) and toluene are used. The detector used is a refractive index (RI) detector.

Meanwhile, a fraction collector is disposed at an eluate outlet of GPC, to fraction the eluate per a certain count. The eluate is obtained per 5% in terms of the area ratio from the elution onset on the elution curve (rise of the curve).

Next, each eluted fraction, as a sample, in an amount of 30 mg is dissolved in 1 mL of deuterated chloroform, and to this solution, 0.05% by volume of tetramethyl silane (TMS) is added as a standard material.

A glass tube for NMR having a diameter of 5 mm is charged with the solution, from which a spectrum is obtained by a nuclear magnetic resonance apparatus (JNM-AL 400, product of JEOL Ltd.) by performing multiplication 128 times at temperature of 23° C. to 25° C.

The monomer compositions and the compositional ratios of the non-linear, non-crystalline polyester resin A, the non-crystalline polyester resin B, and the crystalline polyester resin C in the toner are determined from peak integral ratios of the obtained spectrum.

For example, an assignment of a peak is performed in the following manner, and a constituent monomer component ratio is determined from each integral ratio.

The assignment of a peak is as follows:

Around 8.25 ppm: derived from a benzene ring of trimellitic acid (for one hydrogen atom)

Around the region of 8.07 ppm to 8.10 ppm: derived from a benzene ring of terephthalic acid (for four hydrogen atoms)

Around the region of 7.1 ppm to 7.25 ppm: derived from a benzene ring of bisphenol A (for four hydrogen atoms)

Around 6.8 ppm: derived from a benzene ring of bisphenol A (for four hydrogen atoms), and derived from a double bond of fumaric acid (for two hydrogen atoms)

Around the region of 5.2 ppm to 5.4 ppm: derived from methine of bisphenol A propylene oxide adduct (for one hydrogen atom)

Around the region of 3.7 ppm to 4.7 ppm: derived from methylene of a bisphenol A propylene oxide adduct (for two hydrogen atoms), and derived from methylene of a bisphenol A ethylene oxide adduct (for four hydrogen atoms)

Around 1.6 ppm: derived from a methyl group of bisphenol A (for six hydrogen atoms).

From these results, for example, the extracted product collected in the fraction in which the non-linear, non-crystalline polyester resin A contains 90% by mass or more can be treated as the non-linear, non-crystalline polyester resin A.

Similarly, the extracted product collected in the fraction in which the non-crystalline polyester resin B contains 90% by mass or more can be treated as the non-crystalline polyester resin B. The extracted product collected in the fraction in which the crystalline polyester resin C contains 90% by mass or more can be treated as the crystalline polyester resin C.

<<Measurement Method of Amount of Al on Toner Surface by XPS>>

An amount of Al on the toner surface in the present invention is originated from smectite in the charge controlling agent. Thus, a covering state of the charge controlling agent can be determined. Results are detected as atom % (number).

In the present invention, the measurements are determined by the following devices under the following measurement conditions.

A sample is charged into an aluminum tray, and then the tray is attached to a specimen holder by using a carbon sheet. A relative sensitivity factor of Kratos is employed in order to calculate a concentration of the surface atom.

Measuring device: AXIS-ULTRA, product of Kratos
Measuring light source: Al (monochromator)
Measuring output: 105 W (15 kV, 7 mA)
Analysical area: 900×600 $\mu m^2$
Measuring mode: Hybrid mode
Pass energy: (wide scan) 160 eV,
(narrow scan) 40 eV
Energy step size: (wide scan) 1.0 eV,
(narrow scan) 0.2 eV Relative sensitivity factor: Relative sensitivity factor of Kratos is used.

<<Measurement Methods of Melting Point and Glass Transition Temperature (Tg)>>

In the present invention, a melting point and a glass transition temperature (Tg) can be measured, for example, by a differential scanning calorimeter (DSC) system (Q-200, manufactured by TA Instruments Japan Inc.).

Specifically, the measurements are performed in the following manners.

Specifically, first, an aluminum sample container charged with about 5.0 mg of a sample is placed on a holder unit, and the holder unit is then set in an electric furnace. Next, the sample is heated (first heating) from −80° C. to 150° C. at the heating rate of 10° C./min in a nitrogen atmosphere. Then, the sample is cooled from 150° C. to −80° C. at the cooling rate of 10° C./min, followed by again heating (second heating) to 150° C. at the heating rate of 10° C./min. DSC curves are respectively measured for the first heating and the second heating by a differential scanning calorimeter (Q-200, manufactured by TA Instruments Japan Inc.).

The DSC curve for the first heating is selected from the obtained DSC curve by an analysis program stored in the Q-200 system, to thereby determine a glass transition temperature of the sample with the first heating. Similarly, the DSC curve for the second heating is selected, and the glass transition temperature of the sample with the second heating can be determined.

Moreover, the DSC curve for the first heating is selected from the obtained DSC curve by the analysis program stored in the Q-200 system, and an endothermic peak top temperature of the sample for the first heating is determined as a melting point of the sample. Similarly, the DSC curve for the second heating is selected, and the endothermic peak top temperature of the sample for the second heating can be determined as a melting point of the sample with the second heating.

In the case where a toner is used as a sample, glass transition temperature for the first heating is represented as Tg1st, and glass transition temperature for the second heating is represented as Tg2nd in the present invention.

Also in the present invention, regarding the glass transition temperature and the melting point of the non-linear, non-crystalline polyester resin A, the non-crystalline polyester resin B, the crystalline polyester resin C, and the other constituent components such as the release agent, the endothermic peak top temperature and the Tg in second heating are defined as the melting point and the Tg of each of the target samples, respectively, unless otherwise specified.

<<Measurement Method for Particle Size Distribution>>

The volume average particle diameter (D4), the number average particle diameter (Dn), and the ratio therebetween (D4/Dn) of the toner can be measured using, for example, Coulter Counter TA-II or Coulter Multisizer II (these products are of Coulter, Inc.). In the present invention, Coulter Multisizer II was used. The measurement method is as follows.

First, a surfactant (0.1 mL to 5 mL), preferably a polyoxyethylene alkyl ether (nonionic surfactant), is added as a dispersing agent to an aqueous electrolyte solution (100 mL to 150 mL). Here, the aqueous electrolyte solution is an about 1% by mass aqueous NaCl solution prepared using 1st grade sodium chloride, and ISOTON-II (product of Coulter, Inc.) can be used as the aqueous electrolyte solution. Next, a measurement sample in an amount of 2 mg to 20 mg is added therein. The resultant aqueous electrolyte solution in which the sample has been suspended is dispersed with an ultrasonic wave disperser for about 1 min to about 3 min. The thus-obtained dispersion liquid is analyzed with the above-described apparatus using an aperture of 100 μm to measure the number or volume of the toner particles (or toner). Then, the volume particle size distribution and the number particle size distribution are calculated from the obtained values. From these distributions, the volume average particle diameter (D4) and the number average particle diameter (Dn) of the toner can be obtained.

In this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

<<Measurement of Molecular Weight>>

The molecular weight of each of the constituent components of the toner or the resin can be measured by the following method, for example.

Gel permeation chromatography (GPC) measuring apparatus: GPC-8220GPC (product of TOSOH CORPORATION)

Column: TSKgel Super HZM-H 15 cm, 3 columns connected (product of TOSOH CORPORATION)

Temperature: 40° C.
Solvent: THF
Flow rate: 0.35 mL/min
Sample: 0.15% by mass sample (0.4 mL) applied Pretreatment of sample: The toner or the resin is dissolved in tetrahydrofuran (THF) (containing a stabilizer, product of Wako Pure Chemical Industries, Ltd.) in a concentration of 0.15% by mass, and the solution is filtrated with a 0.2-μm filter. The resultant filtrate is used as a sample. This THF sample solution (100 μL) is applied for measurement.

In the measurement of the molecular weight of the sample, the molecular weight distribution of the sample is determined based on the relationship between the logarithmic value and the count number of a calibration curve given by using several monodisperse polystyrene-standard samples. The standard polystyrene samples used for giving the calibration curve are Showdex STANDARD Std. Nos. S-7300, S-210, S-390, S-875, S-1980, S-10.9, S-629, S-3.0 and S-0.580 (these products are of SHOWA DENKO K.K.). The detector used is a refractive index (RI) detector.

<Production Method of the Toner>

A production method of the toner is not particularly limited and may be appropriately selected depending on the intended purpose. The production method thereof preferably includes dispersing an oil phase in an aqueous medium, where the oil phase is prepared by dissolving or dispersing toner materials in an organic solvent, where the organic materials includes a binder resin component containing a non-crystalline polyester resin and a crystalline polyester resin; and a charge controlling agent.

A toner of the present invention is preferably a toner obtained by dispersing an oil phase in an aqueous medium for granulation, where the oil phase contains the non-linear, non-crystalline polyester resin A, the non-crystalline polyester resin B, the crystalline polyester resin C, and the charge controlling agent, and further contains the release agent and the colorant if necessary.

Also, a toner of the present invention is preferably a toner obtained by dispersing an oil phase in an aqueous medium for granulation, where the oil phase contains the non-linear, reactive precursor, the non-crystalline polyester resin B, the crystalline polyester resin C, and the charge controlling agent, if necessary, further contains the curing agent, the release agent, and the colorant.

In the toner obtained as described above, organic resin particles and a sub-material such as a dispersing agent (e.g., surfactant) are contained therein, and thus it is better to wash the toner in order to remove the aforementioned materials and in order to remove substances having a high polarity and are remaining on the surface of the organic resin particles.

Thus, a production method of the toner of the present invention more preferably includes supplying an alkaline compound to the toner to wash the toner.

The toner is washed by supplying an alkaline compound thereto, and thus the organic resin particles on the toner surface are removed. The organic resin particles, which are fixing inhibitor, are removed, and thus low temperature fixing ability of the toner is improved. Also the toner is improved in charging ability because a ratio of the toner surface covered with a charge controlling agent is increased.

One example of such production methods for the toner is a known dissolution suspension method.

As one example of the production methods for the toner, a method for forming toner base particles by dispersing producing the non-linear, non-crystalline polyester resin A through elongating reaction and/or cross-linking reaction between the non-linear, reactive precursor and the curing agent, is described below. This method includes preparing an aqueous medium, preparing an oil phase containing toner materials, emulsification or dispersion of the toner materials, removing an organic solvent, and washing the toner.

The toner is subjected to washing and drying, and then an external additive may be further added to toner particles which have been subjected to classification.

-Preparation of Aqueous Medium (Aqueous Phase)-

The preparation of the aqueous phase can be carried out, for example, by dispersing organic resin particles in an aqueous medium.

The organic resin particles are used as a dispersion (emulsification) stabilizer in order to sharpen the particle size distribution of the toner.

Any resin can be used for the organic resin particle so long as it can form a water dispersion, and either a thermoplastic resin or a thermosetting resin may be used. Examples thereof include vinyl-based resin, polyurethane resin, epoxy resin, polyester resin, polyamide resin, polyimide resin, silicone-based resin, phenol resin, melamine resin, urea resin, aniline resin, ionomer resin, and polycarbonate resin. The organic resin particle can be used in combination of two or more of the above-mentioned resins without any problem. Among them, vinyl-based resin, polyurethane resin, epoxy resin, polyester resin, and combination thereof are preferable because fine spherical resin particles-containing water dispersion can be easily obtained. As vinyl-based resin, it is a polymer obtained by homopolymerization or copolymerization of vinyl-based monomers. Examples thereof include stylene-(meth)acrylic acid ester copolymer, stylene-butadiene copolymer, (meth)acrylic acid-acrylic acid ester copolymer, stylene-acrylonitrile copolymer, stylene-maleic anhydride copolymer, and stylene-(meth)acrylic acid copolymer. In particular, as a vinyl-based resin, a copolymer of stylene-methacrylic acid-methacrylic acid ethylene oxide adduct sulfate ester is preferably used.

An amount of the organic resin particles added in an aqueous medium is not particularly limited and may be appropriately selected depending on the intended purpose. It is preferably 0.5 parts by mass to 10 parts by mass relative to 100 parts by mass of the aqueous medium.

The aqueous medium is not particularly limited and may be appropriately selected depending on the intended purpose. Examples thereof include water, a solvent miscible with water, and a mixture thereof. These may be used alone or in combination of two or more thereof. Among them, water is preferable.

The solvent miscible with water is not particularly limited and may be appropriately selected depending on the intended purpose. Examples thereof include alcohol, dimethyl formamide, tetrahydrofuran, cellosolve, and lower ketone. The alcohol is not particularly limited and may be appropriately selected depending on the intended purpose. Examples thereof include methanol, isopropanol, and ethylene glycol. The lower ketone is not particularly limited and may be appropriately selected depending on the intended purpose. Examples thereof include acetone and methyl ethyl ketone.

<<Preparation of Oil Phase>>

Preparation of the oil phase containing the toner materials can be performed by dissolving or dispersing toner materials in an organic solvent, where the toner materials contain at least the non-linear, non-crystalline precursor, the non-crystalline polyester resin B, the crystalline polyester resin C, and the charge controlling agent, and further contain the curing agent, the release agent, the colorant, if necessary.

The organic solvent is not particularly limited and may be appropriately selected depending on the intended purpose, but it is preferably an organic solvent having a boiling point of lower than 150° C., as removal thereof is easy.

The organic solvent having the boiling point of lower than 150° C. is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination of two or more thereof.

Among them, ethyl acetate, toluene, xylene, benzene, methylene chloride, 1,2-dichloroethane, chloroform, and carbon tetrachloride are particularly preferable, and ethyl acetate is more preferable.

<<Emulsification or Dispersion>>

The emulsification or dispersion of the toner materials can be carried out by dispersing an oil phase containing the toner materials in the aqueous medium. In the course of the emulsification or dispersion of the toner materials, the curing agent and the non-linear, non-crystalline precursor are allowed to carry out a chain-elongation reaction and/or cross-linking reaction, to thereby obtain the non-linear, non-crystalline polyester resin A.

The non-linear, non-crystalline polyester resin A may be formed by, for example, any of methods (1) to (3) below.

(1) A method for producing the non-linear, non-crystalline polyester resin A, including emulsifying or dispersing, in the aqueous medium, the oil phase containing the non-linear, reactive precursor and the curing agent, and allowing, in the aqueous medium, the curing agent and the non-linear, reactive precursor to undergo elongating reaction and/or cross-linking reaction.

(2) A method for producing the non-linear, non-crystalline polyester resin A, including emulsifying or dispersing, in the aqueous medium, the oil phase containing the non-linear, reactive precursor which the curing agent has been added in advance, and allowing, in the aqueous medium, the curing agent and the non-linear, reactive precursor to undergo elongating reaction and/or cross-linking reaction.

(3) A method for producing the non-linear, non-crystalline polyester resin A, including emulsifying or dispersing, in the aqueous medium, the oil phase containing the non-linear, reactive precursor, adding the curing agent to the resultant aqueous medium, and allowing, in the aqueous medium, the curing agent and the non-linear, reactive precursor to undergo elongating reaction and/or cross-linking reaction from the interfaces of the particles.

Incidentally, in the case where the curing agent and the non-linear, reactive precursor are allowed to undergo elongating reaction and/or cross-linking reaction from the interfaces of the particles, the non-linear, non-crystalline polyester resin A is formed preferentially in the surfaces of the formed toner particles and as a result, a concentration gradient of the non-linear, non-crystalline polyester resin A can be provided in each of the toner particles.

The reaction conditions (e.g., the reaction time and reaction temperature) for generating the non-linear, non-crystalline polyester resin A are not particularly limited and may be appropriately selected depending on a combination of the curing agent and the non-linear, reactive precursor.

The reaction time is not particularly limited and may be appropriately selected depending on the intended purpose, but it is preferably 10 minutes to 40 hours, more preferably 2 hours to 24 hours.

The reaction temperature is not particularly limited and may be appropriately selected depending on the intended purpose, but it is preferably 0° C. to 150° C., more preferably 40° C. to 98° C.

A method for stably forming dispersion liquid containing the non-linear, reactive precursor in the aqueous medium is not particularly limited and may be appropriately selected depending on the intended purpose. Examples thereof include a method in which an oil phase, which has been prepared by dissolving or dispersing toner materials in an organic solvent, is added to a phase of an aqueous medium, followed by dispersing with shear force.

A disperser used for the dispersing is not particularly limited and may be appropriately selected depending on the intended purpose. Examples thereof include a low-speed shearing disperser, a high-speed shearing disperser, a friction disperser, a high-pressure jetting disperser and an ultrasonic wave disperser.

Among them, the high-speed shearing disperser is preferable, because it can control the particle diameters of the dispersed elements (oil droplets) to the range of 2 μm to 20 μm.

In the case where the high-speed shearing disperser is used, the conditions for dispersing, such as the rotating speed, dispersion time, and dispersion temperature, may be appropriately selected depending on the intended purpose.

The rotational speed is not particularly limited and may be appropriately selected depending on the intended purpose, but it is preferably 1,000 rpm to 30,000 rpm, more preferably 5,000 rpm to 20,000 rpm.

The dispersion time is not particularly limited and may be appropriately selected depending on the intended purpose, but it is preferably 0.1 minutes to 5 minutes in case of a batch system.

The dispersion temperature is not particularly limited and may be appropriately selected depending on the intended purpose, but it is preferably 0° C. to 150° C., more preferably 40° C. to 98° C. under pressure. Note that, generally speaking, dispersion can be easily carried out, as the dispersion temperature is higher.

An amount of the aqueous medium used for the emulsification or dispersion of the toner material is not particularly limited and may be appropriately selected depending on the intended purpose, but it is preferably 50 parts by mass to 2,000 parts by mass, more preferably 100 parts by mass to 1,000 parts by mass, relative to 100 parts by mass of the toner material.

When the amount of the aqueous medium is less than 50 parts by mass, the dispersion state of the toner material is impaired, which may result a failure in attaining toner base particles having desired particle diameters. When the amount thereof is more than 2,000 parts by mass, the production cost may increase.

When the oil phase containing the toner material is emulsified or dispersed, a dispersant is preferably used for the purpose of stabilizing dispersed elements, such as oil droplets, and gives a shape particle size distribution as well as giving desirable shapes of toner particles.

The dispersant is not particularly limited and may be appropriately selected depending on the intended purpose. Examples thereof include a surfactant, a water-insoluble inorganic compound dispersant, and a polymer protective colloid. These may be used alone or in combination of two or more thereof. Among them, the surfactant is preferable.

The surfactant is not particularly limited and may be appropriately selected depending on the intended purpose. Examples thereof include an anionic surfactant, a cationic surfactant, a nonionic surfactant, and an amphoteric surfactant.

The anionic surfactant is not particularly limited and may be appropriately selected depending on the intended purpose. Examples thereof include alkyl benzene sulfonic acid salts, α-olefin sulfonic acid salts and phosphoric acid esters. Among them, those having a fluoroalkyl group are preferable.

In cases where the non-linear, non-crystalline polyester resin A is generated, a catalyst can be used for a chain-elongation reaction and/or cross-linking reaction.

The catalyst is not particularly limited and may be appropriately selected depending on the intended purpose. Examples thereof include dibutyltin laurate and dioctyltin laurate.

<<Removal of Organic Solvent>>

A method for removing the organic solvent from the dispersion liquid such as the emulsified slurry is not particularly limited and may be appropriately selected depending on the intended purpose. Examples thereof include: a method in which an entire reaction system is gradually heated to evaporate out the organic solvent in the oil droplets; and a method in which the dispersion liquid is sprayed in a dry atmosphere to remove the organic solvent in the oil droplets.

As the organic solvent removed, toner base particles are formed. The toner base particles can be subjected to washing and drying, and can be further subjected to classification. The classification may be carried out in a liquid by removing small particles by cyclone, a decanter, or centrifugal separator, or may be performed on particles after drying.

<<Washing>>

As a method of washing the toner, a method of supplying an alkaline compound to the toner to wash the toner is preferable. Examples thereof suitably include a method where the toner is washed with alkaline, followed by washing with acid and then with water.

When the toner is washed with alkaline, an emulsifier, a dispersant, and ionic impurities existing on the surface of the toner particle can be removed.

Particularly, in toner particles containing at least the non-linear, non-crystalline polyester resin A, the organic resin particles are used as a dispersion (emulsification) stabilizer in order to obtain the toner having a sharp particle diameter distribution. When the organic resin particles excessively presents on the toner surface, fixing ability of the toner may be inhibited and the resultant toner may be deteriorate in charging ability. Thus, the organic resin particles are preferably removed from the toner.

In this respect, the organic resin particles contain an acid component, and thus they are swollen or dissolved by washing the toner with alkaline, to thereby remove them with ease.

The alkaline compound is not particularly limited and may be appropriately selected depending on the intended purpose. Examples thereof include sodium hydroxide and potassium hydroxide.

A pH in a step of washing the toner with the alkaline compound is preferably 8 to 13. When the pH is less than 8, removal of the organic resin particles is insufficient, and thus the toner does not exhibit the effects on low temperature fixing ability and charging ability of the toner. Moreover, when the pH is more than 13, a binder resin may be discomposed.

The amine is used in order to produce the non-linear, non-crystalline polyester resin A. However, an unreacted amine may form an association with an acid group (carboxylic group) in the non-crystalline polyester resin B, and thus elongation reaction may not be smoothly proceeded after emulsification. In addition the unreacted amine may cause low acidity in the non-crystalline polyester resin B, which may impair charging ability and lower adhesion to paper.

In this respect, when the washing the toner with alkaline is performed, a hydrogen atom of a terminal carboxylic acid in the non-crystalline polyester resin B is substituted with a Na atom. Then, the resultant toner is washed with acid, and thus the terminal carboxyl group in the polyester resin is formed again. Thus the elongation reaction can be allowed to proceed again.

<<Mixing>>

The obtained toner base particles may be mixed with particles such as the external additive. At this time, by applying a mechanical impact during the mixing, the particles such as the external additive can be prevented from fall off from surfaces of the toner base particles.

A method for applying the mechanical impact is not particularly limited and may be appropriately selected depending on the intended purpose. Examples thereof include: a method for applying impulse force to a mixture by a blade rotating at high speed; a method for adding a mixture into a high-speed air flow and accelerating the speed of the flow to thereby make the particles crash into other particles, or make the composite particles crush into an appropriate impact board.

A device used for this method is appropriately selected depending on the intended purpose without any limitation, and examples thereof include ANGMILL (product of Hosokawa Micron Corporation), an apparatus produced by modifying I-type mill (product of Nippon Pneumatic Mfg. Co., Ltd.) to reduce the pulverizing air pressure, a hybridization system (product of Nara Machinery Co., Ltd.), a kryptron system (product of Kawasaki Heavy Industries, Ltd.) and an automatic mortar.

(Developer)

A developer of the present invention contains at least the toner, and may further contain appropriately selected other components, such as carrier, if necessary.

Accordingly, the developer has excellent transfer properties, and charging ability, and can stably form high quality images.

Note that, the developer may be a one-component developer, or a two-component developer, but it is preferably a two-component developer when it is used in a high speed printer corresponding to recent high information processing speed, because the service life thereof can be improved.

In the case where the developer is used as a one-component developer, the diameters of the toner particles do not vary largely even when the toner is supplied and consumed repeatedly, the toner does not cause filming to a developing roller, nor fuse to a layer thickness regulating member such as a blade for thinning a thickness of a layer of the toner, and provides excellent and stable developing ability and image even when it is stirred in the developing device over a long period of time.

In the case where the developer is used as a two-component developer, the diameters of the toner particles in the developer do not vary largely even when the toner is supplied and consumed repeatedly, and the toner can provide excellent and stabile developing ability even when the toner is stirred in the developing device over a long period of time.

<Carrier>

The carrier is appropriately selected depending on the intended purpose without any limitation, but it is preferably a carrier containing a core, and a resin layer covering the core.

<<Core>>

A material of the core is appropriately selected depending on the intended purpose without any limitation, and examples thereof include a 50 emu/g to 90 emu/g manganese-strontium (Mn—Sr) material, and a 50 emu/g to 90 emu/g manganese-magnesium (Mn—Mg) material. To secure a sufficient image density, use of a hard magnetic material such as iron powder (100 emu/g or higher), and magnetite (75 emu/g to 120 emu/g) is preferable. Moreover, use of a soft magnetic material such as a 30 emu/g to 80 emu/g copper-zinc material is preferable because an impact applied to a photoconductor by the developer born on a bearer in the form of a brush can be reduced, which is an advantageous for improving image quality.

These may be used alone or in combination of two or more thereof.

The volume average particle diameter of the core is not particularly limited and may be appropriately selected depending on the intended purpose, but it is preferably 10 μm to 150 μm, more preferably 40 μm to 100 μm. When the volume average particle diameter thereof is less than 10 μm, the proportion of particles in the distribution of carrier particle diameters increases, causing carrier scattering because of low magnetization per carrier particle. When the volume average particle diameter thereof is more than 150 μm, the specific surface area reduces, which may cause toner scattering, causing reproducibility especially in a solid image portion in a full color printing containing many solid image portions.

In the case where the toner is used for a two-component developer, the toner is used by mixing with the carrier. An amount of the carrier in the two-component developer is not particularly limited and may be appropriately selected depending on the intended purpose, but it is preferably 90 parts by mass to 98 parts by mass, more preferably 93 parts by mass to 97 parts by mass, relative to 100 parts by mass of the two-component developer.

The developer of the present invention may be suitably used in image formation by various known electrophotographic methods such as a magnetic one-component developing method, a non-magnetic one-component developing method, and a two-component developing method.

(Developer Accommodating Container)

A developer accommodating container accommodates the developer of the present invention. The container thereof is not particularly limited and may be appropriately selected from known containers. Examples thereof include those having a cap and a container main body.

The size, shape, structure and material of the container main body are not particularly limited. The container main body preferably has, for example, a hollow-cylindrical shape. Particularly preferably, it is a hollow-cylindrical body whose inner surface has spirally-arranged concavo-convex portions some or all of which can accordion and in which the developer accommodated can be transferred to an outlet port through rotation. The material for the developer-accommodating container is not particularly limited and is preferably those from which the container main body can be formed with high dimensional accuracy. Examples thereof include polyester resins, polyethylene resins, polypropylene resins, polystyrene resins, polyvinyl chloride resins, polyacrylic acids, polycarbonate resins, ABS resins and polyacetal resins.

The above developer accommodating container has excellent handleability; i.e., is suitable for storage, transportation, and is suitably used for supply of the developer with being detachably mounted to, for example, the below-described process cartridge and image forming apparatus.

(Image Forming Apparatus)

An image forming apparatus including a toner of the present invention includes an electrostatic latent image bearer, an electrostatic latent image forming unit, and a developing unit, further includes other units if necessary.

The image forming apparatus preferably includes an electrostatic latent image bearer, an electrostatic latent image forming unit, a developing unit, a transfer unit, and a fixing unit; more preferably includes a cleaning unit; and further includes a charge-eliminating step, a recycling step, and a controlling step, if necessary.

<Electrostatic Latent Image Bearer>

The material, structure and size of the electrostatic latent image bearer are not particularly limited and may be appropriately selected depending on the intended purpose. Examples of the material thereof include inorganic photoconductors such as amorphous silicon and selenium and organic photoconductors such as polysilane and phthalopolymethine. Among them, amorphous silicon is preferable in order to obtain long lifetime.

<Electrostatic Latent Image Forming Unit>

The electrostatic latent image forming unit is not particularly limited and may be appropriately selected depending on the intended purpose so long as it is a unit configured to form an electrostatic latent image on the electrostatic latent image bearer. Examples thereof include a unit including at least a charging member configured to charge a surface of the electrostatic latent image bearer and an exposing member configured to imagewise expose the surface of the electrostatic latent image bearer to light.

<<Charging Member and Charging>>

The charging member is not particularly limited and may be appropriately selected depending on the intended purpose. Examples thereof include contact-type charging devices known per se having, for example, an electrically conductive or semiconductive roller, brush, film and rubber blade; and non-contact-type charging devices utilizing corona discharge such as corotron and scorotron.

The charging can be performed by, for example, applying voltage to the surface of the electrostatic latent image bearer by using the charging member.

<<Exposing Member and Exposure>>

The exposing member is not particularly limited and may be appropriately selected depending on the purpose so long as it attains desired imagewise exposure on the surface of the electrophotographic latent image bearer charged with the charging member. Examples thereof include various exposing members such as a copy optical exposing device, a rod lens array exposing device, a laser optical exposing device, and a liquid crystal shutter exposing device.

The exposure can be performed by, for example, imagewise exposing the surface of the electrostatic latent image bearer to light using the exposing member.

In the present invention, light may be imagewise applied from the side facing the support of the electrostatic latent image bearer.

<Developing Unit>

The developing unit is not particularly limited and may be appropriately selected depending on the intended purpose so long as it is a developing unit containing a toner which develops the electrostatic latent image formed on the electrostatic latent image bearer, to thereby form a visible image.

The developing unit is not particularly limited so long as it can perform development using a toner of the present invention. A developing unit including developing device which accommodates a developer of the present invention, and can impart the toner to the electrostatic latent image in a contact manner or contactless manner, can be used, and a developing device including a developer accommodating container of the present invention is preferably used.

The developing device may employ a dry or wet developing process, and may be a single-color or multi-color developing device.

The developing device is preferably a developing device containing: a stirring device for charging a developer of the present invention with friction generated during stirring; and a rotatable magnet roller.

In the developing device, toner particles and carrier particles are stirred and mixed so that the toner particles are charged by friction generated therebetween. The charged toner particles are retained in the chain-like form on the surface of the rotating magnetic roller to form magnetic brushes. The magnetic roller is disposed proximately to the electrostatic latent image developing member and thus, some of the toner particles forming the magnetic brushes on the magnet roller are transferred onto the surface of the electrostatic latent image developing member by the action of electrically attractive force. As a result, the electrostatic latent image is developed with the toner particles to form a visual toner image on the surface of the electrostatic latent image developing member. Note that, a developer accommodated in the developer may be a one-component developer, or a two-component developer, so long as it includes a toner of the present invention.

<Other Units>

Examples of the other units include a transfer unit, a fixing unit, a cleaning unit, a charge-eliminating unit, a recycling unit, and a controlling unit.

<<Transfer Unit>>

The transfer unit is not particularly limited and may be appropriately selected depending on the intended purpose so long as it is a unit configured to transfer the visible image onto a recording medium. Preferably, the transfer unit includes: a primary transfer unit configured to transfer the visible images to an intermediate transfer member to form a composite transfer image; and a secondary transfer unit configured to transfer the composite transfer image onto a recording medium.

Here, when the image to be secondarily transferred onto the recording medium is a color image of several color toners, a configuration can be employed in which the transfer unit sequentially superposes the color toners on top of another on the intermediate transfer member to form an image on the intermediate transfer member, and the image on the intermediate transfer member is secondarily transferred at one time onto the recording medium by the intermediate transfer unit.

The intermediate transfer member is not particularly limited and may be appropriately selected from known transfer members depending on the intended purpose. For example, the intermediate transfer member is preferably a transferring belt.

The transfer unit (including the primary- and secondary transfer units) preferably includes at least a transfer device which transfers the visible images from the photoconductor onto the recording medium. Examples of the transfer device include a corona transfer device employing corona discharge, a transfer belt, a transfer roller, a pressing transfer roller and an adhesive transferring device.

The recording medium is not particularly limited and may be appropriately selected depending on the purpose, so long as it can receive a developed, unfixed image. Examples of the recording medium include plain paper and a PET base for OHP, with plain paper being used typically.

<<Fixing Unit>>

The fixing unit is not particularly limited and may be appropriately selected depending on the intended purpose as long as it is a unit configured to fix a transferred image which has been transferred on the recording medium, but is preferably known heating-pressurizing members. Examples thereof include a combination of a heat roller and a press roller, and a combination of a heat roller, a press roller and an endless belt.

The heating-pressurizing member usually performs heating preferably at 80° C. to 200° C.

Notably, in the present invention, known photofixing devices may be used instead of or in addition to the fixing unit depending on the intended purpose.

<<Cleaning Unit>>

The cleaning unit is not particularly limited and may be appropriately selected depending on the intended purpose, as long as it can remove the toner remaining on the electrostatic latent image bearer. Examples thereof include a magnetic brush cleaner, an electrostatic brush cleaner, a magnetic roller cleaner, a blade cleaner, a brush cleaner and a web cleaner.

<<Charge-Eliminating Unit>>

The charge-eliminating unit is not particularly limited and may be appropriately selected depending on the intended purpose, as long as it is a unit configured to apply a charge-eliminating bias to the electrostatic latent image bearer to thereby charge-eliminate. Examples thereof include a charge-eliminating lamp.

<<Recycling Unit>>

The recycling unit is not particularly limited and may be appropriately selected depending on the intended purpose, as long as it is a unit configured to recycle the toner which has been removed at the cleaning step to the developing unit. Examples thereof include a known conveying unit.

<<Control Unit>>

The control unit is not particularly limited and may be appropriately selected depending on the intended purpose, as long as it can control the operation of each of the above units. Examples thereof include devices such as sequencer and computer.

Next, one aspect of a method for forming an image using an image forming apparatus of the present invention will be explained with reference to FIG. 1. An image forming apparatus 100A illustrated in FIG. 1 includes a photoconductor drum 10 serving as an electrostatic latent image bearer, a charging roller 20 serving as a charging unit, an exposing device (not illustrated) serving as an exposing unit, developing devices 45 (K, Y, M, C) serving as a developing unit, an intermediate transfer member 50, a cleaning device 6 containing a cleaning blade serving as a cleaning unit, and a charge-eliminating lamp 70 serving as a charge-eliminating unit.

The intermediate transfer member 50, which is an endless belt, is stretched around three rollers 51 disposed in the belt, and is movable in a direction indicated by the arrow in FIG. 1. A part of the three rollers 51 also functions as a transfer bias roller which can apply a predetermined transfer bias (primary transfer bias) to the intermediate transfer member 50.

Also, a cleaning device 90 including a cleaning blade is disposed near the intermediate transfer member 50. Further, a transfer roller 80 serving as a transfer unit which can apply a transfer bias onto recording paper 95 for transferring (secondary transferring) a toner image is disposed facing the intermediate transfer member 50.

In addition, around the intermediate transfer member 50, a corona charging device 52 for applying a charge to the toner image on the intermediate transfer member 50 is disposed between a contact portion of the photoconductor drum 10 with the intermediate transfer member 50 and a contact portion of the intermediate transfer member 50 with the recording paper 95.

Each of the developing devices 45 of black (K), yellow (Y), magenta (M), and cyan (C) is equipped with a developer accommodating unit 42 (K, Y, M, or C), a developer supply roller 43, and a developing roller 44.

In the image forming apparatus 100A, the photoconductor drum 10 is uniformly charged by the charging roller 20, and then the exposing unit (not illustrated) imagewise exposes the photoconductor drum 10 to a light L, to thereby form an electrostatic latent image. Next, the electrostatic latent image formed on the photoconductor drum 10 is developed by supplying a developer from the developing device 45, to thereby form a toner image. Then, the toner image is transferred (primarily transferred) onto the intermediate transfer member 50 by a transfer bias applied from the roller 51. Further, the toner image on the intermediate transfer member 50 is provided with charge by the corona charging device 52, and then is transferred (secondarily transferred) on the recording paper 95. Note that, a residual toner remaining on the photoconductor drum 10 is removed by the cleaning device 6, and the photoconductor drum 10 is once charge-eliminated by the charge-eliminating lamp 70.

Figure 2:
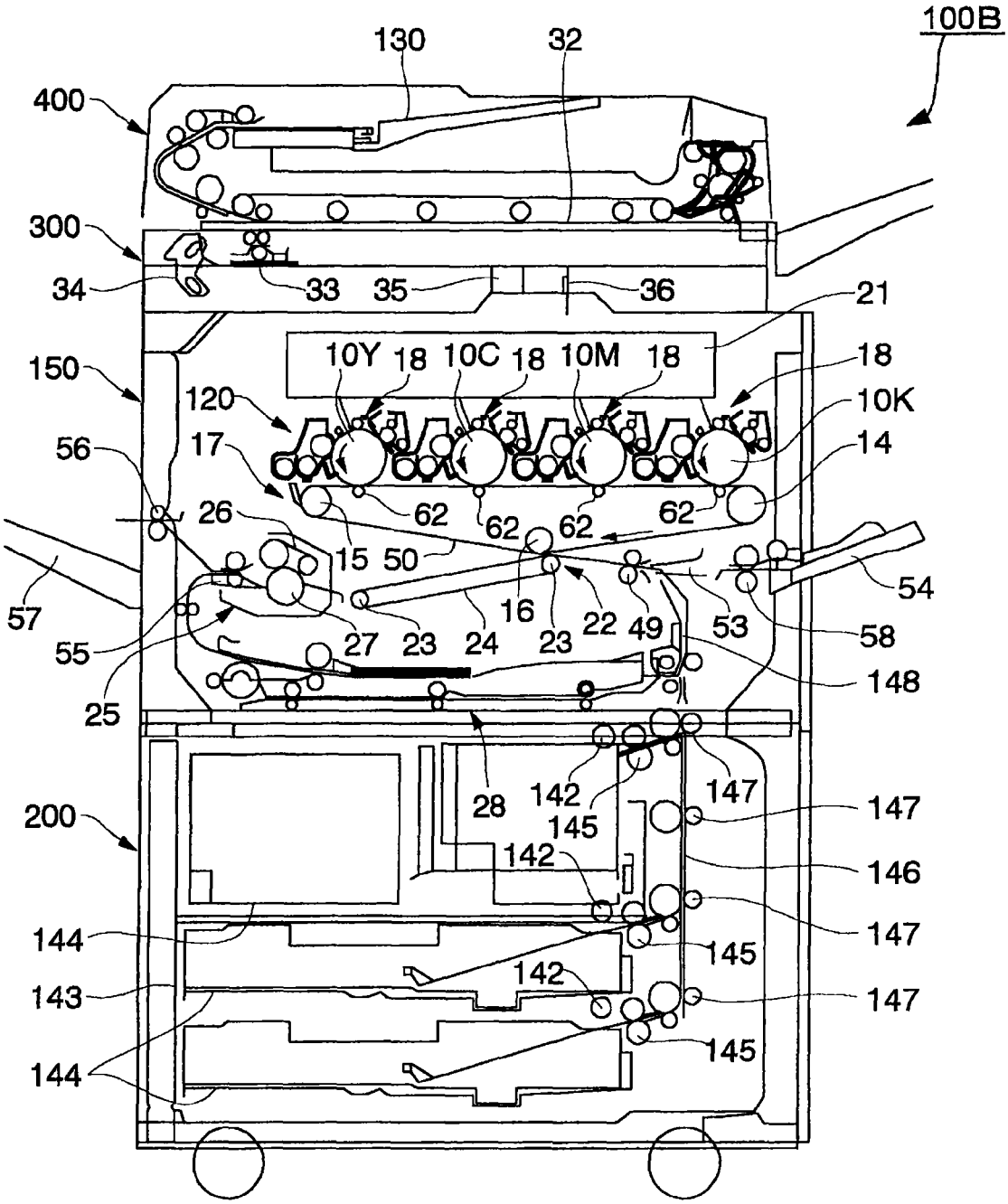
FIG. 2 is a schematic structural view of another example of an image forming apparatus of the present invention.

FIG. 2 illustrates another example of an image forming apparatus of the present invention. An image forming apparatus 100B is a tandem type color image forming apparatus, and includes a copying device main body 150, a paper feeding table 200, a scanner 300 and an automatic document feeder (ADF) 400.

An intermediate transfer member 50, which is an endless belt type, is disposed at a central part of the copying device main body 150. The intermediate transfer member 50 is stretched around support rollers 14, 15 and 16 and can rotate in direction indicated by the arrow in FIG. 2.

Near the support roller 15, a cleaning device 17 is disposed in order to remove a residual toner remaining on the intermediate transfer member 50. On the intermediate transfer member 50 stretched by the support rollers 14 and 15, a tandem type developing device 120 is disposed in which four image forming units 18 of yellow, cyan, magenta and black are arranged in parallel so as to face to each other along a conveying direction thereof.

Figure 3:
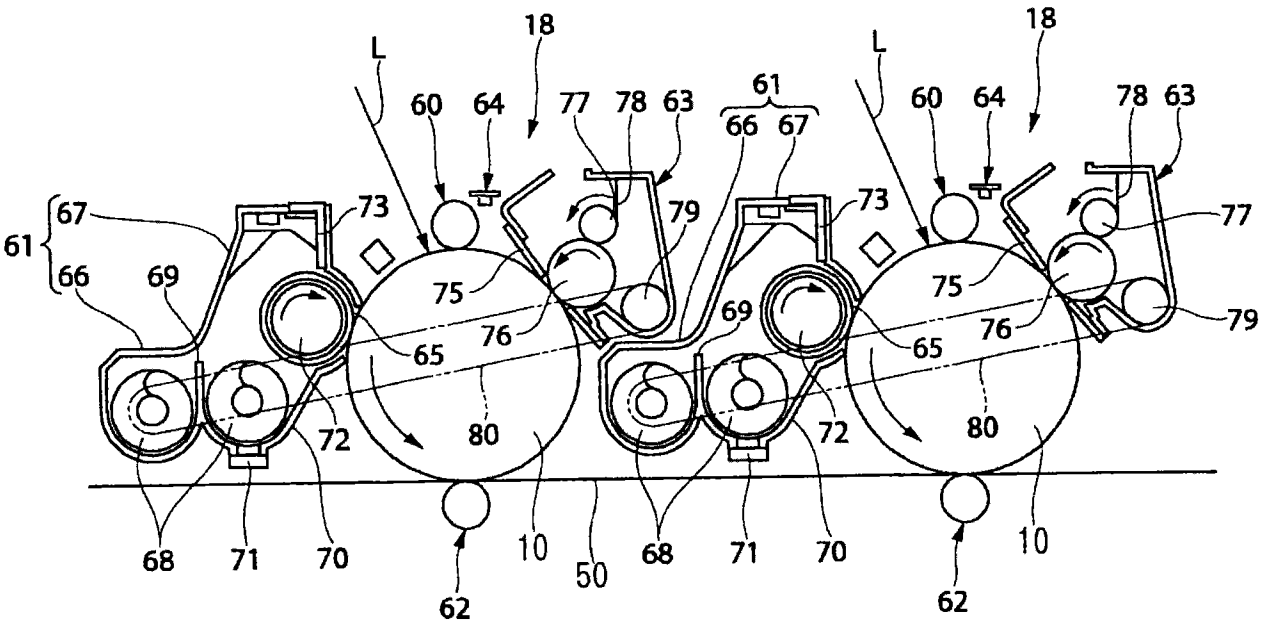
FIG. 3 is a schematic structural view of one example of an image-forming unit of the image forming apparatus illustrated for each color.

As shown in FIG. 3, an image forming unit 18 for each color is equipped with a photoconductor drum 10; a charging roller 60 configured to uniformly charge the photoconductor drum 10; a developing device 70 configured to form a toner image by developing an electrostatic latent image formed on the photoconductor drum 10 using a developer for each color (black (K), yellow (Y), magenta (M), and cyan (C)); a transfer roller 62 configured to transfer the toner image of each colors onto the intermediate transfer member 50; a cleaning device 63; and a charge-eliminating lamp 64.

In an image forming apparatus illustrated in FIG. 2, an exposing device (not illustrated) is disposed near the tandem type developing device 120. The exposing device exposes the photoconductor drum 10 to a light, to thereby form an electrostatic latent image.

Further, a secondary transfer device 22 is disposed on a side of the intermediate transfer member 50 opposite to the side thereof where the tandem type developing device 120 is provided. The secondary transfer device 22 includes the secondary transfer belt 24, which is an endless belt, and is stretched around a pair of rollers 23. The recording paper conveyed on the secondary transfer belt 24 and the intermediate transfer member 50 may contact with each other.

A fixing device 25 is disposed near the secondary transfer device 22. The fixing device 25 includes a fixing belt 26 which is an endless belt, and a press roller 27 which is disposed so as to be pressed against the fixing belt 26.

Moreover, an inverting device 28 is disposed near the secondary transfer device 22 and the fixing device 25 for inverting the recording paper in order to form an image on both sides of the recording paper.

Next, a method for forming a full-color image (color-copying) using the image forming apparatus 100B will be explained hereinafter. First, a document is set on a document table 130 of the automatic document feeder (ADF) 400. Alternatively, the automatic document feeder 400 is opened, the color document is set on a contact glass 32 of the scanner 300, and the automatic document feeder 400 is closed. When a start button (not illustrated) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, a light is irradiated from a light source in the first travelling body 33, the light reflected from a surface of the document is reflected by a mirror in the second travelling body 34 and then is received by a reading sensor 36 through an imaging forming lens 35. Thus, the color document (color image) is read to thereby obtain the image information for colors of black, yellow, magenta and cyan.

Based on the obtained image information for each color by the exposing device, each of the electrostatic latent image is formed on the photoconductor drum 10, and each of the electrostatic latent image is developed with a developer provided from the developing device 120 for each color, to thereby form a toner image for each color. The formed toner image for each color is transferred on top of one another (primarily transferred) onto the intermediate transfer member 50 which is rotatably moved by the support rollers 14, 15 and 16, to thereby form a composite toner image on the intermediate transfer member 50.

On the paper feeding table 200, one of a paper feeding rollers 142 is selectively rotated to feed a recording paper from one of the paper feeding cassettes 144 equipped in multiple stages in a paper bank 143. The recording paper is separated one by one by a separation roller 145 and sent to a paper feeding path 146. The recording paper is conveyed by a conveying roller 147 and is guided to a paper feeding path 148 in the copying device main body 150, and stops by colliding with a registration roller 49. Alternatively, a recording paper on a manual feed tray 54 is fed, and is separated one by one by a separation roller 58. Then, the recording paper is guided to a manual paper feeding path 53, and stops by colliding with the registration roller 49. Notably, the registration roller 49 is generally used while grounded, but it may also be used in a state that a bias is being applied for removing paper dust on the recording paper.

Next, the registration roller 49 is rotated in synchronization with formation of the composite toner image on the intermediate transfer member 50, and the recording paper is fed to between the intermediate transfer member 50 and the secondary transfer device 22. Then, the composite toner image is transferred (secondarily transferred) onto the recording paper.

The recording paper on which the composite toner image has been transferred is conveyed by the secondary transfer device 22, and then conveyed to the fixing device 25. In the fixing device 25, the composite toner image is fixed on the recording paper by the action of heat and pressure by the fixing belt 26 and the press roller 27. Next, the recording paper is switched by a switching claw 55, then is discharged by a discharge roller 56, and is stacked in a paper ejection tray 57. Alternatively, the recording paper is switched by the switching claw 55, and is inverted by the inverting device 28 to thereby be guided to a transfer position again. After that, an image is formed similarly on the rear surface, then the recording paper is discharged by the discharge roller 56, and is stacked in the paper ejection tray 57.

Note that, after the composite toner image is transferred, a residual toner remaining on the intermediate transfer member 50 is removed by the cleaning device 17.

(Process Cartridge)

A process cartridge of the present invention is molded so as to be mounted to various image forming apparatuses in an attachable and detachable manner, including at least an electrostatic latent image bearer configured to bear an electrostatic latent image; and a developing unit configured to form a toner image by developing the electrostatic latent image formed on the electrostatic latent image bearer with a developer of the present invention. Note that, the process cartridge of the present invention may further include other units, if necessary.

The developing unit includes a developer accommodating container configured to accommodate a developer of the present invention, and a developer bearing member configured to bear and convey the developer accommodated in the developer accommodating container. Note that, the developing unit further includes a regulating member in order to regulate a thickness of the born developer.

Figure 4:
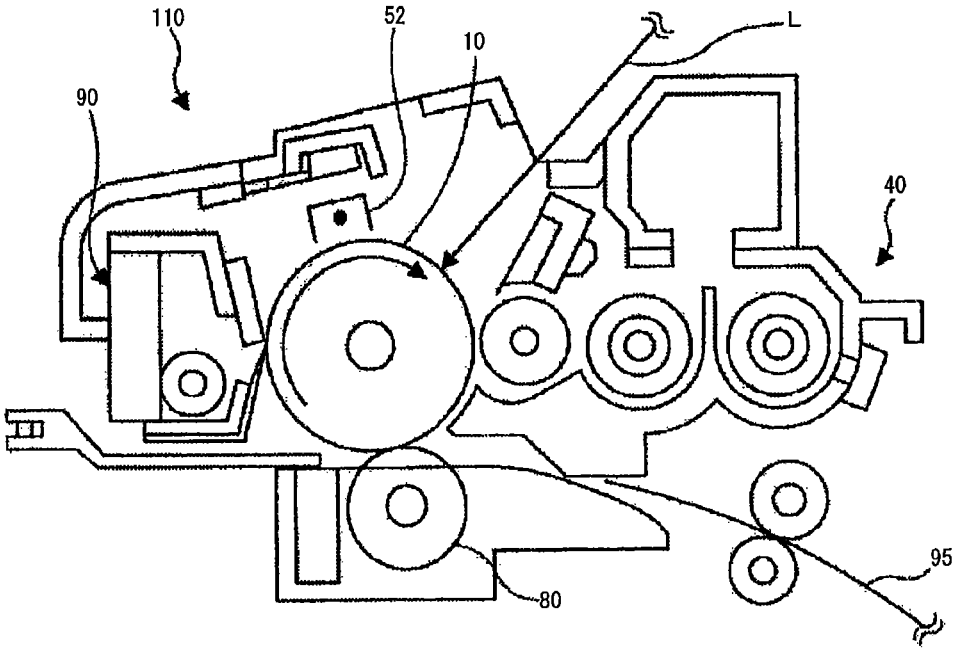
FIG. 4 is a schematic structural view of one example of a process cartridge.

FIG. 4 illustrates one example of a process cartridge of the present invention. A process cartridge 110 includes a photoconductor drum 10, a corona charging device 52, a developing device 40, a transfer roller 80, and a cleaning device 90.

EXAMPLES

The present invention will be described by way of Examples below. The present invention may not be construed as being limited to the Examples. Unless otherwise specified, "part(s)" means "part(s) by mass", and "%" means "% by mass".

<THF Insoluble Matter>

The THF insoluble matter of the toner was obtained as follows.

The toner (1 part) was added to 40 parts of tetrahydrofuran (THF), and the resultant mixture was refluxed for 6 hours. Then, an insoluble matter in the resultant mixture was allowed to precipitate by a centrifugal separator, and was separated into an insoluble component and a supernatant.

The insoluble component was dried at 40° C. for 20 hours, to thereby obtain THF insoluble matter.

<Method for Measuring Amount of Al (%) on the Toner Surface Based on XPS>

An amount of Al (atom % (number)) was determined by the following devices under the following conditions.

A sample was charged into an aluminum tray, and then the tray was attached to a specimen holder by using a carbon sheet for the measurement of X-ray photoelectron spectroscopic analysis (XPS) (%). A relative sensitivity factor of Kratos was employed in order to calculate a concentration of the surface atom.

Measuring device: AXIS-ULTRA, product of Kratos
Measuring light source: Al (monochromator)
Measuring output: 105 W (15 kV, 7 mA)
Analysical area: 900×600 $\mu m^2$
Measuring mode: Hybrid mode
Pass energy: (wide scan) 160 eV,
(narrow scan) 40 eV
Energy step size: (wide scan) 1.0 eV,
(narrow scan) 0.2 eV
Relative sensitivity factor: Used relative sensitivity factor of Kratos <Methods for Measuring Melting Point and Glass Transition Temperature (Tg)>

A melting point and a glass transition temperature (Tg) were measured by DSC system (differential scanning calorimeter, Q-200: product of TA Instruments Japan Inc.) in the following manners.

First, about 5.0 mg of a sample was charged into an aluminum sample container, then the container was placed on a holder unit, and the holder unit was then set in an electric furnace. Next, the sample was heated (first heating) from −80° C. to 150° C. at the heating rate of 10° C./min in a nitrogen atmosphere. Then, the sample was cooled from 150° C. to −80° C. at the cooling rate of 10° C./min, followed by again heating (second heating) to 150° C. at the heating rate of 10° C./min. DSC curves were respectively measured for the first heating and the second heating by a differential scanning calorimeter (Q-200: product of TA Instruments Japan Inc.).

The obtained DSC curve for the first heating was selected from the obtained DSC curve by an analysis program stored in the Q-200 system, to thereby determine glass transition temperature of the sample with the first heating. Similarly, the DSC curve for the second heating was selected, and the glass transition temperature of the sample with the second heating was determined.

Moreover, the obtained DSC curve for the first heating was selected from the obtained DSC curve by the analysis program stored in the Q-200 system, and an endothermic peak top temperature of the sample for the first heating was determined as a melting point of the sample. Similarly, the DSC curve for the second heating was selected, and the endothermic peak top temperature of the sample for the second heating was determined as a melting point of the sample with the second heating.

<Measurement of Molecular Weight>

The molecular weight of each of the constituent components of the toner was measured by the following method.

Gel permeation chromatography (GPC) measuring apparatus: GPC-8220GPC (product of TOSOH CORPORATION)

Column: TSKgel Super HZM-H 15 cm, 3 columns connected (product of TOSOH CORPORATION)

Temperature: 40° C.

Solvent: THF

Flow rate: 0.35 mL/min

Sample: 0.15% by mass sample (0.4 mL)

Pretreatment of sample: The toner or the resin was dissolved in tetrahydrofuran (THF) (containing a stabilizer, product of Wako Pure Chemical Industries, Ltd.) in a concentration of 0.15% by mass, and the solution was filtrated with a 0.2 μm filter. The resultant filtrate was used as a sample. This THF sample solution (100 μL) was applied for measurement.

In the measurement of the molecular weight of the sample, the molecular weight distribution of the sample was determined based on the relationship between the logarithmic value and the count number of a calibration curve given by using several monodisperse polystyrene-standard samples. The standard polystyrene samples used for giving the calibration curve were Showdex STANDARD Std. Nos. S-7300, S-210, S-390, S-875, S-1980, S-10.9, S-629, S-3.0 and S-0.580 (these products are of SHOWA DENKO K.K.). The detector used was a RI (refractive index) detector.

Each of the measurement values was measured by the above-mentioned methods. Notably, a Tg, a melting point, and a molecular weight of each of the non-linear, non-crystalline polyester resin A, the non-crystalline polyester resin B, the crystalline polyester resin C were measured using each of the resin obtained in Production Examples.

Production Example 1

Synthesis of Ketimine

A reaction container equipped with a stirring rod and a thermometer was charged with isophorone diisocyanate (170 parts) and methyl ethyl ketone (75 parts), followed by reaction at 50° C. for 5 hours, to thereby obtain [ketimine compound 1]. The amine value of the obtained [ketimine compound 1] was found to be 418.

Production Example A1

Synthesis of Non-Linear, Non-Crystalline Polyester Resin A1

-Synthesis of Prepolymer A1-

A reaction vessel equipped with a condenser, a stirring device, and a nitrogen-introducing tube was charged with 3-methyl-1,5-pentanediol, isophthalic acid, and adipic acid so that a ratio by mole of hydroxyl group to carboxyl group "OH/COOH" was 1.5. A diol component was composed of 100% by mole of 3-methyl-1,5-pentanediol, and a dicarboxylic acid component was composed of 40% by mole of isophthalic acid and 60% by mole of adipic acid. An amount of trimethylolpropane was added thereto so that the amount thereof was 1% by mole relative to the total amount of the monomers. Moreover, titanium tetraisopropoxide (1,000 ppm relative to the resin component) was added thereto. Thereafter, the resultant mixture was heated to 200° C. for about 4 hours, then was heated to 230° C. for 2 hours, and allowed to react until no flowing water was formed. Thereafter, the reaction mixture was allowed to further react for 5 hours under a reduced pressure of 10 mmHg to 15 mmHg, to thereby obtain intermediate polyester A1.

Next, a reaction vessel equipped with a condenser, a stirring device, and a nitrogen-introducing tube was charged with the obtained intermediate polyester A1 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A1.

-Synthesis of Non-Linear, Non-Crystalline Polyester Resin A1-

The obtained prepolymer A1 was stirred in a reaction vessel equipped with a heating device, a stirring device, and a nitrogen-introducing tube. The [ketimine compound 1] was added dropwise to the reaction vessel in such an amount that the amount by mole of amine in the [ketimine compound 1] was equal to the amount by mole of isocyanate in the prepolymer A1. The reaction mixture was stirred at 45° C. for 10 hours, and then the polymer product extended was taken out. The obtained polymer product extended was dried at 50° C. under a reduced pressure until the amount of the remaining ethyl acetate was 100 ppm or less, to thereby obtain non-linear, non-crystalline polyester resin A1. Composition of the alcohol component and the acid component is shown in Table 1.

Also, the weight average molecular weight (Mw) and the glass transition temperature (Tg) of the non-linear, non-crystalline polyester resin A1 are shown in Table 1.

Production Example A2

Synthesis of Non-Linear, Non-Crystalline Polyester Resin A2

-Synthesis of Prepolymer A2-

A reaction vessel equipped with a condenser, a stirring device, and a nitrogen-introducing tube was charged with bisphenol A ethylene oxide 2 mole adduct, bisphenol A propylene oxide 3 mole adduct, isophthalic acid, and adipic acid, so that a ratio by mole of hydroxyl group to carboxyl group "OH/COOH" was 1.5. A diol component was composed of bisphenol A ethylene oxide 2 mole adduct and bisphenol A propylene oxide 3 mole adduct and a ratio by mole of the diol component (bisphenol A ethylene oxide 2 mole adduct/bisphenol A propylene oxide 3 mole adduct) was 80/20; and a dicarboxylic acid component was composed of 85% by mole of isophthalic acid and 15% by mole of adipic acid. An amount of the trimellitic anhydride was added thereto so that the amount thereof was 1% by mole relative to the total amount of the monomers. Moreover, titanium tetraisopropoxide (1,000 ppm relative to the resin component) was added thereto. The resultant mixture was heated to 200° C. for about 4 hours, then was heated to 230° C. for 2 hours, and was allowed to react until no flowing water was formed. Thereafter, the reaction mixture was allowed to further react for 5 hours under a reduced pressure of 10 mmHg to 15 mmHg, to thereby produce intermediate polyester A2.

Next, a reaction vessel equipped with a condenser, a stirring device, and a nitrogen-introducing tube was charged with the intermediate polyester A2 and isophorone diisocyanate (IPDI) at a ratio by mole of 2.0 (as the isocyanate group of the IPDI/the hydroxyl group of the intermediate polyester). The resultant mixture was diluted with ethyl acetate so as to be a 50% ethyl acetate solution, followed by reaction at 100° C. for 5 hours, to thereby produce prepolymer A2.

-Synthesis of Non-Linear, Non-Crystalline Polyester Resin A2-

The obtained prepolymer A2 was stirred in a reaction vessel equipped with a heating device, a stirrer, and a nitrogen-introducing tube. Then, the [ketimine compound 1] was added dropwise to the reaction vessel in such an amount that the amount by mole of amine in the [ketimine compound 1] was equal to the amount by mole of isocyanate in the prepolymer A2. The reaction mixture was stirred at 45° C. for 10 hours, and then a polymer product extended was taken out. The obtained polymer product extended was dried at 50° C. under a reduced pressure until the amount of the remaining ethyl acetate was 100 ppm or less, to thereby obtain non-linear, non-crystalline polyester resin A2.

The weight average molecular weight (Mw) and the glass transition temperature (Tg) of the non-linear, non-crystalline polyester resin A2 are shown in Table 1.

Production Examples A3 to A7

Synthesis of Non-Linear, Non-Crystalline Polyester Resins A3 to A7

-Synthesis of Prepolymers A3 to A7-

Prepolymers A3 to A7 were obtained in the same manner as in the synthesis of prepolymer A1 except that the alcohol component and the acid component were changed to those shown in columns of A3 to A7 in Table 1.

Note that, each of the values means mixing ratio (% by mole) in the columns of the alcohol component and the acid component as shown in Table 1.

-Synthesis of Non-Linear, Non-Crystalline Polyester Resins A3 to A7-

Non-linear, non-crystalline polyester resins A3 to A7 were obtained in the same manner as in the synthesis of non-linear, non-crystalline polyester resin A1 except that prepolymer A1 was changed to each of the prepolymers A3 to A7.

The weight average molecular weight (Mw) and the glass transition temperature (Tg) of each of the non-linear, non-crystalline polyester resins A3 to A7 are shown in Table 1.

TABLE 1

| | Diol | Dicarboxylic acid | Mw | Tg |
|---|---|---|---|---|
| A1 | 3-Methyl1,5-pentanediol (100) | Isophthalic acid/adipic acid (40/60) | 16,400 | −40 |
| A2 | BisAEO/3-Methyl1,5-pentanediol (80/20) | Isophthalic acid/adipic acid (85/15) | 45,000 | 52 |
| A3 | BisAEO/3-Methyl1,5-pentanediol (80/20) | Terephthalic acid/adipic acid (50/50) | 18,900 | 40 |
| A4 | 3-Methyl1,5-pentanediol (100) | Isophthalic acid/adipic acid (90/10) | 12,000 | 0 |
| A5 | 3-Methyl1,5-pentanediol (100) | Isophthalic acid/adipic acid (80/20) | 19,100 | −5 |
| A6 | 3-Methyl1,5-pentanediol (100) | Isophthalic acid/adipic acid (30/70) | 17,000 | −65 |
| A7 | 3-Methyl1,5-pentanediol (100) | Decanedioic acid (100) | 19,000 | −7 |

In the above Table 1, "BisAEO" means bisphenol A ethylene oxide 2 mole adduct.

Production Example B1

Synthesis of Non-Crystalline Polyester Resin B1

A four-necked flask equipped with a nitrogen-introducing tube, a dehydration tube, a stirring device, and a thermocouple was charged with bisphenol A ethylene oxide 2 mole adduct, bisphenol A propylene oxide 3 mole adduct, terephthalic acid, and adipic acid so that a ratio by mole of hydroxyl group to carboxyl group "OH/COOH" was 1.3. A ratio of bisphenol A ethylene oxide 2 mole adduct to bisphenol A propylene oxide 3 mole adduct was set to 60/40 (% by mole), and a ratio of terephthalic acid to adipic acid was set to 93/7 (% by mole). Moreover, titanium tetraisopropoxide (500 ppm relative to the resin component) was added thereto, and the resultant mixture was allowed to react under normal pressure at 230° C. for 8 hours and then to further react under a reduced pressure of 10 mmHg to 15 mmHg for 4 hours. Trimellitic anhydride was added to the reaction vessel so that an amount thereof was 1% by mole relative to the total resin components, followed by reaction at 180° C. under normal pressure for 3 hours, to thereby obtain non-crystalline polyester resin B1. Composition of the alcohol component and the acid component is shown in Table 2.

Also, the weight average molecular weight (Mw) and the glass transition temperature (Tg) of the non-crystalline polyester resin B1 are shown in Table 2.

Production Examples B2 and B3

Synthesis of Non-Crystalline Polyester Resins B2 and B3

Non-crystalline polyester resins B2 and B3 were obtained in the same manner as in the synthesis of the non-crystalline polyester resin B1 except that the composition of the alcohol component and the acid component was changed as shown in Table 2.

The weight average molecular weight (Mw) and the glass transition temperature (Tg) of the non-crystalline polyester resins B2 and B3 are shown in Table 2.

TABLE 2

| | Diol | Dicarboxylic acid | Mw | Tg |
|---|---|---|---|---|
| B1 | BisAPO/BisAEO (60/40) | Terephthalic acid/adipic acid (97/3) | 8,700 | 70 |
| B2 | BisAPO/BisAEO (15/85) | Isophthalic acid/adipic acid (80/20) | 4,500 | 42 |
| B3 | BisAPO/BisAEO (30/70) | Isophthalic acid/adipic acid (80/20) | 5,000 | 48 |

In the above Table 2, "BisAEO" means bisphenol A ethylene oxide 2 mole adduct, and "BisAPO" means bisphenol A propylene oxide 3 mole adduct.

Production Example C1

Synthesis of Crystalline Polyester Resin C1

A four-necked flask of 5 L equipped with a nitrogen-introducing tube, a dehydration tube, a stirring device, and a thermocouple was charged with sebacic acid and 1,6-hexanediol so that a ratio by mole of hydroxyl group to carboxyl group "OH/COOH" was 0.9. Moreover, titanium tetraisopropoxide (500 ppm relative to the resin component) was added thereto, and the resultant mixture was allowed to react under normal pressure at 180° C. for 10 hours, heated to 200° C., allowed to react 3 hours, and then to react under a pressure of 8.3 kPa for 2 hours to thereby obtain a crystalline polyester resin C1 (weight average molecular weight (Mw): 16,400, melting point (Tm): 67° C.).

Example 1

Synthesis of Master Batch (MB) 1

Water (1,200 parts), 500 parts of carbon black (Printex 35, product of Evonik Degussa Japan Co., Ltd.) [DBP oil absorption amount=42 mL/100 mg, pH=9.5], and 500 parts of the non-crystalline polyester resin B1 were added and mixed together by HENSCHEL MIXER (product of Mitsui Mining Co., Ltd.), and the resultant mixture was kneaded by a two roll mill for 30 minutes at 150° C. The kneaded product was rolled out and cooled, followed by pulverizing by a pulverizer, to thereby obtain [master batch 11].

<Preparation of WAX Dispersion Liquid 1>

A vessel to which a stirring bar and a thermometer had been set was charged with 50 parts of paraffin wax (HNP-9, product of Nippon Seiro Co., Ltd., hydrocarbon wax, melting point: 75° C.) as a release agent, and 450 parts of ethyl acetate, followed by heating to 80° C. with stirring. The temperature was maintained at 80° C. for 5 hours, followed by cooling to 30° C. for 1 hour. The resultant mixture was dispersed by a bead mill (ULTRA VISCOMILL, product of AIMEX CO., Ltd.) under the conditions: a liquid feed rate of 1 kg/hr, disc circumferential velocity of 6 m/s, zirconia beads having a diameter of 0.5 mm packed to 80% by volume, and 3 passes, to thereby obtain [WAX dispersion liquid 1].

<Preparation of Crystalline Polyester Resin Dispersion Liquid 1>

A vessel to which a stirring bar and a thermometer had been set was charged with 308 parts of the crystalline polyester resin C1, 1,900 parts of ethyl acetate, followed by heating to 80° C. with stirring. The temperature was maintained at 80° C. for 5 hours, followed by cooling to 30° C. for 1 hour. The resultant mixture was dispersed by a bead mill (ULTRA VISCOMILL, product of AIMEX CO., Ltd.) under the conditions: a liquid feed rate of 1 kg/hr, disc circumferential velocity of 6 m/s, zirconia beads having a diameter of 0.5 mm packed to 80% by volume, and 3 passes, to thereby obtain [crystalline polyester resin dispersion liquid 1].

<Charge Controlling Agent>

A charge controlling agent was used when an oil phase was prepared. The used charge controlling agents are shown in Table 3.

TABLE 3

| | Charge controlling agent | Makers |
|---|---|---|
| 1 | CRAYTONE APA | Product of SCP |
| 2 | BENTONE 57 | Product of ELEMENTIS |
| 3 | S-BEN NZ | Product of HOJUN |

<Preparation of Oil Phase 1>

A vessel was charged with 190 parts of the [WAX dispersion liquid 1], 32 parts of the [prepolymer A1], 290 parts of the [crystalline polyester resin dispersion liquid 1], 65 parts of the [non-crystalline polyester resin B1], 100 parts of the [master batch 1], 1.8 parts of the [charge controlling agent 1] and 0.2 parts of the [ketimine compound 1], followed by mixing using a TK Homomixer (product of Tokushu Kika Kogyo Co., Ltd.) at 7,000 rpm for 60 minutes, to thereby obtain [oil phase 1].

Note that, the above amounts each mean an amount of solid content in each of the materials.

<Synthesis of Organic Resin Particle Emulsion (Particle Dispersion Liquid 1)>

A reaction vessel equipped with a stirring bar and a thermometer was charged with 683 parts of water, 11 parts of a sodium salt of sulfuric acid ester of methacrylic acid-ethylene oxide adduct (ELEMINOL RS-30, product of Sanyo Chemical Industries, Ltd.), 138 parts of styrene, 138 parts of methacrylic acid, and 1 part of ammonium persulfate, and the resultant mixture was stirred for 15 minutes at 400 rpm, to thereby obtain a white emulsion. The obtained emulsion was heated to have the system temperature of 75° C., and was then allowed to react for 5 hours. To the resultant, 30 parts of a 1% ammonium persulfate aqueous solution was added, followed by aging for 5 hours at 75° C., to thereby obtain an aqueous dispersion liquid of a vinyl resin (a copolymer of styrene/methacrylic acid/sodium salt of sulfuric acid ester of methacrylic acid ethylene oxide adduct), i.e., [particle dispersion liquid 1].

The [particle dispersion liquid 1] was measured by LA-920 (product of HORIBA, Ltd.), and as a result, the volume average particle diameter thereof was found to be 0.14 μm. A part of the [particle dispersion liquid 1] was dried, and a resin component thereof was isolated.

<Preparation of Aqueous Phase 1>

Water (990 parts), 83 parts of the [particle dispersion liquid 1], 37 parts of a 48.5% aqueous solution of sodium dodecyldiphenyl ether disulfonate (ELEMINOL MON-7, product of Sanyo Chemical Industries Ltd.), and 90 parts of ethyl acetate were mixed and stirred, to thereby obtain an opaque white liquid. The obtained liquid was used as [aqueous phase 1].

<Emulsification•Removal of Solvent>

The [aqueous phase 1] (1,200 parts) was added to a container charged with 677 parts of the [oil phase 1], and the resultant mixture was mixed by a TK Homomixer at 8,000 rpm for 20 minutes, to thereby obtain [emulsified slurry 1].

A container equipped with a stirrer and a thermometer was charged with the [emulsified slurry 1], followed by removing the solvent therein at 30° C. for 8 hours. Thereafter, the resultant was matured at 45° C. for 4 hours, to thereby obtain [dispersion slurry 1].

<Washing•Drying>

After subjecting 100 parts of the [dispersion slurry 1] to filtration under a reduced pressure, the obtained cake was subjected twice to a series of treatments (1) to (4) described below, to thereby produce [filtration cake 1]:

(1): ion-exchanged water (100 parts) was added to the filtration cake, followed by mixing with a TK Homomixer (at 12,000 rpm for 10 minutes) and then filtration;

(2): ion-exchanged water (100 parts) was added to the filtration cake obtained in (1), 10% aqueous sodium hydroxide solution was added thereto so that pH was 12, followed by mixing with a TK Homomixer (at 12,000 rpm for 30 minutes), and then the resultant mixture was filtrated under a reduced pressure;

(3): 10% by mass hydrochloric acid (100 parts) was added to the filtration cake obtained in (2), followed by mixing with a TK Homomixer (at 12,000 rpm for 10 minutes) and then filtration; and (4): ion-exchanged water (300 parts) was added to the filtration cake obtained in (3), followed by mixing with a TK Homomixer (at 12,000 rpm for 10 minutes) and then filtration.

Next, the [filtration cake 1] was dried with an air-circulating drier at 45° C. for 48 hours, and then was caused to pass through a sieve with a mesh size of 75 μm, to thereby obtain [toner base particle 1].

<Step of External Additive Treatment>

The [toner base particle 1] (100 parts) and 0.6 parts of the hydrophobic silica (R972, product of NIPPON AEROSIL CO., LTD.) were mixed by HENSCHEL MIXER, and then the resultant mixture was caused to pass through a sieve with a mesh having a sieve opening of 500 mesh, to thereby obtain [toner 1].

Example 2

A toner of Example 2 was obtained in the same manner as in Example 1 except that the step of adding 10% aqueous sodium hydroxide solution was omitted in the <Washing•drying> of Example 1.

Example 3

A toner of Example 3 was obtained in the same manner as in Example 1 except that the amount of the charge controlling agent 1 was changed from 1.8 parts to 0.9 parts in the <Preparation of oil phase> of Example 1.

Example 4

A toner of Example 4 was obtained in the same manner as in Example 3 except that the step of adding 10% aqueous sodium hydroxide solution was omitted in the <Washing•drying> of Example 3.

Example 5

A toner of Example 5 was obtained in the same manner as in Example 1 except that the charge controlling agent 1 was changed to the charge controlling agent 2 in the <Preparation of oil phase> of Example 1.

Example 6

A toner of Example 6 was obtained in the same manner as in Example 5 except that the prepolymer A1 was changed to the prepolymer A3; that the non-crystalline polyester resin B1 was changed to the non-crystalline polyester resin B2; that the amount of the charge controlling agent 2 was changed from 1.8 parts to 2.4 parts in the <Preparation of oil phase>; and that the step of adding 10% aqueous sodium hydroxide solution was omitted in the <Washing•drying>.

Example 7

A toner of Example 7 was obtained in the same manner as in Example 1 except that the prepolymer A1 was changed to the prepolymer A4; and that the non-crystalline polyester resin B1 was changed to the non-crystalline polyester resin B3.

Example 8

A toner of Example 8 was obtained in the same manner as in Example 1 except that the prepolymer A1 was changed to the prepolymer A5; that the non-crystalline polyester resin B1 was changed to the non-crystalline polyester resin B3; and that the amount of the controlling agent 1 was changed from 1.8 parts to 2.4 parts in the <Preparation of oil phase>.

Example 9

A toner of Example 9 was obtained in the same manner as in Example 3 except that the prepolymer A1 was changed to the prepolymer A6; and that the non-crystalline polyester resin B1 was changed to the non-crystalline polyester resin B3.

Example 10

A toner of Example 10 was obtained in the same manner as in Example 3 except that the prepolymer A1 was changed to the prepolymer A3.

Example 11

A toner of Example 11 was obtained in the same manner as in Example 5 except that the step of adding 10% aqueous sodium hydroxide solution was omitted in the <Washing•drying> of Example 5.

Example 12

A toner of Example 12 was obtained in the same manner as in Example 6 except that the step of adding 10% aqueous sodium hydroxide solution was added in the <Washing•drying> of Example 6.

Comparative Example 1

A toner of Comparative Example 1 was obtained in the same manner as in Example 2 except that the prepolymer A1 was changed to the prepolymer A2; that the non-crystalline polyester resin B1 was changed to the non-crystalline polyester resin B3; and that the charge controlling agent 1 was changed to the charge controlling agent 3 in the <Preparation of oil phase>.

Comparative Example 2

A toner of Comparative Example 2 was obtained in the same manner as in Example 2 except that the amount of the charge controlling agent 1 was changed from 1.8 parts to 0.2 parts.

Comparative Example 3

A toner of Comparative Example 3 was obtained in the same manner as in Example 5 except that the amount of the charge controlling agent 2 was changed from 1.8 parts to 3.0 parts.

Comparative Example 4

A toner of Comparative Example 4 was obtained in the same manner as in Example 4 except that the prepolymer A1 was changed to the prepolymer A2.

Comparative Example 5

A toner of Comparative Example 5 was obtained in the same manner as in Example 4 except that the amount of the charge controlling agent 1 was changed from 0.9 parts to 0.6 parts; and that the prepolymer A1 was changed to the prepolymer A7.

<Preparation of Developer>

Using a ball mill, each of the toners (5 parts) obtained in the above manner and the carrier (95 parts) obtained in the following manner were mixed to thereby prepare a developer.

-Preparation of Carrier-

Silicone resin: organostraight silicone (100 parts) (KR-282, product of Shin-Etsu silicone), 5 parts of γ-(2-aminoethyl)aminopropyltrimethoxy silane, and 10 parts of carbon black were added to 100 parts of toluene, the resultant mixture was dispersed by a homomixer for 20 minutes, to thereby prepare a resin layer coating liquid. The resin layer coating liquid was coated on 1,000 parts of the surfaces of spherical magnetite particles having an average particle diameter of 50 μm, by a fluidized bed coating device, to thereby prepare a carrier.

<Evaluation>

An amount of Al, [Tg2nd (THF insoluble matter)], [Tg1st (toner)], and [Tg2nd (toner)] of each of the toners were measured by the methods described above. Results are shown in Table 4.

Each of the developers was evaluated based on the following evaluation methods for charge amount, minimum fixing temperature, and heat resistant storage stability. Results are shown in Table 5.

<<Charge Amount>>

A two-component developer (6 g) was weighed and charged into a closable metal cylinder, followed by stirring at 280 rpm of a stirring speed, to thereby determine a charge amount (μC/g) as measured based on a blow-off method. Note that, the two-component developer was stirred for 60 seconds (TA60), and 600 seconds (TA600).

[Evaluation Criteria for Charge Amount]

A: 36 or more

B: 33 or more but less than 36

C: 30 or more but less than 33

D: Less than 30

<<Minimum Fixing Temperature>>

An apparatus provided by modifying a fixing portion of copier MF2200 (product of Ricoh Company, Ltd.) using a TEFLON (registered trademark) roller as a fixing roller was used to perform a copy test on sheets of Type 6,200 paper (product of Ricoh Company, Ltd.).

Specifically, the cold offset temperature (minimum fixing temperature) was determined by changing the fixing temperature.

As the evaluation conditions, the paper-feeding linear velocity was set to 120 mm/sec to 150 mm/sec, the surface pressure was set to 1.2 kgf/cm$^2$, and the nip width was set to 3 mm.

[Evaluation Criteria for Minimum Fixing Temperature]

A: Less than 110° C.

B: 110° C. or more but less than 120° C.

C: 120° C. or more but less than 130° C.

D: 130° C. or more

<<Heat Resistant Storage Stability>>

Each of the resultant toner was stored at 50° C. for 8 hours, and was caused to pass through a sieve of 42-mesh for 2 minutes, to thereby determine a residual rate on a wire mesh. The evaluations were performed based on the following criteria. The more excellent the heat resistant storage stability of the toner is, the smaller the residual rate is.

[Evaluation Criteria for Heat Resistant Storage Stability]

A: The residual rate is less than 10%.

B: The residual rate is 10% or more but less than 20%.

C: The residual rate is 20% or more but less than 30%.

D: The residual rate is 30% or more.

TABLE 4

| | Amount of Al (%) | Tg2nd (THF insoluble matter) (° C.) | Tg1st (toner) (° C.) | Tg2nd (toner) (° C.) |
|---|---|---|---|---|
| Example 1 | 1.2 | −25 | 45 | 21 |
| Example 2 | 1.1 | −25 | 45 | 21 |
| Example 3 | 0.8 | −25 | 44 | 22 |
| Example 4 | 0.7 | −25 | 43 | 21 |
| Example 5 | 1.1 | −25 | 44 | 21 |
| Example 6 | 1.2 | 28 | 47 | 25 |
| Example 7 | 1.2 | 5 | 21 | 3 |
| Example 8 | 1.3 | 0 | 20 | 3 |
| Example 9 | 0.8 | −38 | 18 | −1 |
| Example 10 | 0.8 | 28 | 51 | 32 |
| Example 11 | 1.0 | −25 | 44 | 21 |
| Example 12 | 1.3 | 28 | 47 | 24 |
| Comparative Example 1 | 0.8 | 33 | 40 | 22 |
| Comparative Example 2 | 0.5 | −25 | 44 | 21 |
| Comparative Example 3 | 1.5 | −25 | 47 | 21 |
| Comparative Example 4 | 0.6 | 33 | 55 | 39 |
| Comparative Example 5 | 0.6 | −42 | 41 | 22 |

TABLE 5

| | Charge amount | | Minimum fixing | Heat resistant |
|---|---|---|---|---|
| | TA60 | TA600 | temperature | storage stability |
| Example 1 | A | A | A | B |
| Example 2 | B | B | B | A |
| Example 3 | A | A | A | B |
| Example 4 | B | B | B | A |
| Example 5 | A | B | A | B |
| Example 6 | B | B | B | A |
| Example 7 | A | A | A | B |
| Example 8 | A | A | A | B |
| Example 9 | A | A | A | B |
| Example 10 | A | A | B | B |
| Example 11 | B | B | B | A |
| Example 12 | A | B | A | B |
| Comparative Example 1 | C | C | D | C |
| Comparative Example 2 | D | C | A | B |
| Comparative Example 3 | A | A | D | B |
| Comparative Example 4 | C | C | D | C |
| Comparative Example 5 | C | C | B | A |

Embodiments of the present invention are as follows, for example.

<1> A toner, wherein an amount of Al detected in the toner is 0.7% to 1.3%, where the amount of Al detected is determined based on quantitative analysis of Al by X-ray photoelectron spectroscopic analysis (XPS), and wherein [Tg2nd (THF insoluble matter)] is −40° C. to 30° C., where the [Tg2nd (THF insoluble matter)] is a glass transition temperature measured in second heating of differential scanning calorimetry (DSC) of THF insoluble matter of the toner.

<2> The toner according to <1>, wherein [Tg1st (toner)] is 20° C. to 50° C., where the [Tg1st (toner)] is a glass transition temperature of the toner measured in first heating of differential scanning calorimetry (DSC).

<3> The toner according to any one of <1> to <2>, wherein [Tg2nd (toner)] is 0° C. to 30° C., where the [Tg2nd (toner)] is a glass transition temperature of the toner measured in second heating of differential scanning calorimetry (DSC).

<4> The toner according to any one of <1> to <3>, wherein the toner contains a non-linear, non-crystalline polyester resin having a cross-linked structure.

<5> The toner according to any one of <1> to <4>, wherein the toner contains a crystalline polyester resin.

<6> The toner according to any one of <1> to <5>, wherein the toner contains a charge controlling agent containing an organic modified smectite.

<7> The toner according to any one of <1> to <6>, wherein the toner is produced by a production method including supplying an alkaline compound to the toner to wash the toner.

<8> A developer, including:

the toner according to any one of <1> to <7>; and a carrier.

<9> An image forming apparatus, including:

an electrostatic latent image bearer;

an electrostatic latent image forming unit configured to form an electrostatic latent image on the electrostatic latent image bearer; and a developing unit containing a toner and configured to develop the electrostatic latent image formed on the electrostatic latent image bearer, to thereby form a visible image, wherein the toner is the toner according to any one of <1> to <8>.

This application claims priority to Japanese application No. 2014-098558, filed on May 12, 2014 and incorporated herein by reference.

What is claimed is:

1. A toner, comprising:

a non-crystalline polyester resin;

a crystalline polyester resin; and a charge controlling agent, wherein an amount of Al detected in the toner is 0.7 atomic % to 1.3 atomic %, where the amount of Al detected is determined based on quantitative analysis of Al by X-ray photoelectron spectroscopic analysis (XPS), and

[Tg2nd (THF insoluble matter)] is −40° C. to 30° C., where the [Tg2nd (THF insoluble matter)] is a glass transition temperature of a THF insoluble component of the toner measured by differential scanning calorimetry (DSC) after heating the THF insoluble component from −80° C. to 150° C. at a heating rate of 10° C./min in a nitrogen atmosphere, cooling the THF insoluble component from 150° C. to −80° C. at a cooling rate of 10° C./min, and then heating the THF insoluble component to 150° C. at a heating rate of 10° C./min.

2. The toner according to claim 1, wherein [Tg1st (toner)] is 20° C. to 50° C., where the [Tg1st (toner)] is a glass transition temperature of the toner measured by differential scanning calorimetry (DSC) during heating the toner from −80° C. to 150° C. at a heating rate of 10° C./min in a nitrogen atmosphere.

3. The toner according to claim 1, wherein [Tg2nd (toner)] is 0° C. to 30° C., where the [Tg2nd (toner)] is a glass transition temperature of the toner measured by differential scanning calorimetry (DSC) after heating the toner from −80° C. to 150° C. at a heating rate of 10° C./min in a nitrogen atmosphere, cooling the toner from 150° C. to −80° C. at a cooling rate of 10° C./min, and then heating the toner to 150° C. at a heating rate of 10° C./min.

4. The toner according to claim 1, wherein the non-crystalline polyester resin has a cross-linked structure.

5. The toner according to claim 1, wherein the crystalline polyester resin has a weight average molecular weight of 3,000 to 30,000.

6. The toner according to claim 1, wherein the charge controlling agent comprises an organic modified smectite.

7. The toner according to claim 1, wherein the toner is produced by a method comprising washing a toner base particle by supplying an alkaline compound to the toner base particle.

8. A developer, comprising:

the toner according to claim 1; and a carrier.

9. An image forming apparatus, comprising:

an electrostatic latent image bearer;

an electrostatic latent image forming unit configured to form an electrostatic latent image on the electrostatic latent image bearer; and a developing unit containing a toner and configured to develop the electrostatic latent image formed on the electrostatic latent image bearer to form a visible image, wherein an amount of Al detected in the toner is 0.7 atomic % to 1.3 atomic %, where the amount of Al detected is determined based on quantitative analysis of Al by X-ray photoelectron spectroscopic analysis (XPS), and [Tg2nd (THF insoluble matter)] of the toner is −40° C. to 30° C., where the [Tg2nd (THF insoluble matter)] is a glass transition temperature of a THF insoluble component of the toner measured by differential scanning calorimetry (DSC) after heating the THF insoluble component from −80° C. to 150° C. at a heating rate of 10° C./min in a nitrogen atmosphere, cooling the THF insoluble component from 150° C. to −80° C. at a cooling rate of 10° C./min, and then heating the THF insoluble component to 150° C. at a heating rate of 10° C./min.

10. The toner according to claim 1, wherein the non-crystalline polyester resin has a non-linear structure and a glass transition temperature of from −65° C. to 40° C.

11. The toner according to claim 10, further comprising:

a second non-crystalline polyester resin having a glass transition temperature of from 40° C. to 80° C.

12. The toner according to claim 11, wherein the non-crystalline polyester resin has a non-linear structure and wherein the toner includes from 5 parts by mass to 25 parts by mass of the non-crystalline, non-linear polyester resin, from 50 parts by mass to 90 parts by mass of the second non-crystalline polyester resin, and from 3 parts by mass to 20 parts by mass of the crystalline polyester resin, relative to 100 parts by mass of the toner.

13. The toner according to claim 11, wherein the non-crystalline polyester resin has a non-linear structure and wherein the toner includes from 10 parts by mass to 20 parts by mass of the non-crystalline, non-linear polyester resin, from 60 parts by mass to 80 parts by mass of the second non-crystalline polyester resin, and from 5 parts by mass to 15 parts by mass of the crystalline polyester resin, relative to 100 parts by mass of the toner.

14. The toner according to claim 1, wherein the non-crystalline polyester resin has a non-linear structure, a glass transition temperature of from −65° C. to 40° C., and a weight average molecular weight of from 10,000 to 100,000.

15. The toner according to claim 1, further comprising:

a second non-crystalline polyester resin having a glass transition temperature of from 40° C. to 80° C. and a weight average molecular weight of from 3,000 to 10,000.

16. The toner according to claim 1, wherein the non-crystalline polyester resin has a non-linear structure and wherein the toner includes from 5 parts by mass to 25 parts by mass of the non-crystalline, non-linear polyester resin and from 3 parts by mass to 20 parts by mass of the crystalline polyester resin, relative to 100 parts by mass of the toner.

17. The toner according to claim 1, wherein the non-crystalline polyester resin has a non-linear structure and wherein the toner includes from 10 parts by mass to 20 parts by mass of the non-crystalline, non-linear polyester resin and from 5 parts by mass to 15 parts by mass of the crystalline polyester resin, relative to 100 parts by mass of the toner.

18. The toner according to claim 1, wherein the non-crystalline polyester resin has a non-linear structure and a glass transition temperature of from −65° C. to 0° C.

19. The toner according to claim 1, wherein the non-crystalline polyester resin has a non-linear structure and is prepared by polycondensation of a diol, a dicarboxylic acid, and at least one of a trihydric or higher alcohol and a trivalent or higher carboxylic acid.

20. The toner according to claim 1, further comprising:

an additive selected from the group consisting of a release agent, a colorant, an external additive, a flow improving agent, a cleaning improving agent, and a magnetic material.

* * * * *